US007537029B2

(12) United States Patent
Gielen et al.

(10) Patent No.: US 7,537,029 B2
(45) Date of Patent: May 26, 2009

(54) JET-WEAVING MACHINE, PARTICULARLY AN AIR JET-WEAVING MACHINE, WITH A CLAMPING DEVICE IN THE MIXING TUBE

(75) Inventors: Markus Gielen, Lindau (DE); Thomas Laukamp, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 153 days.

(21) Appl. No.: 11/658,984

(22) PCT Filed: Jun. 24, 2005

(86) PCT No.: PCT/DE2005/001130

§ 371 (c)(1),
(2), (4) Date: Jan. 29, 2007

(87) PCT Pub. No.: WO2006/012821

PCT Pub. Date: Feb. 9, 2006

(65) Prior Publication Data

US 2008/0156390 A1 Jul. 3, 2008

(30) Foreign Application Priority Data

Jul. 30, 2004 (DE) ..... 10 2004 036 996

(51) Int. Cl.
*D03D 47/28* (2006.01)
*D03D 47/30* (2006.01)
*D03D 47/32* (2006.01)
*D03D 41/00* (2006.01)

(52) U.S. Cl. ..... 139/435.1; 139/435.2; 139/435.3; 139/435.4; 139/435.5; 139/435.6

(58) Field of Classification Search ..... 139/116.1, 139/435.1, 435.2, 435.3, 435.4, 435.5, 435.6, 139/447, 448, 450, 194
See application file for complete search history.

(56) References Cited

U.S. PATENT DOCUMENTS 3,367,372 A * 2/1968 Fransen ..... 139/450
3,675,687 A * 7/1972 Vermeulen et al. ..... 139/435.1
4,190,089 A * 2/1980 Cyvas ..... 139/437
4,476,903 A * 10/1984 Gunneman ..... 139/435.4
4,619,296 A * 10/1986 Hrus et al. ..... 139/435.4

(Continued)

FOREIGN PATENT DOCUMENTS

DE 32 00 638 8/1982

(Continued)

*Primary Examiner*—Bobby H Muromoto, Jr.
(74) *Attorney, Agent, or Firm*—W. F. Fasse; W. G. Fasse

(57) ABSTRACT

A thread clamping device is provided for a jet weaving machine that has a main discharge nozzle (1) with a mixing tube (2) for inserting a weft thread (3) into a shed with a conveying fluid discharged from the main discharge nozzle. This clamping device is placed inside the mixing tube (2) in the area from which the weft thread exits, and has an actuator, which is situated outside of the mixing tube (2), and a lever connected to the actuator so that this lever is actuated by the actuator (6) to execute a tilting or pivoting motion whereby the weft thread is clamped between the lever and an abutment (9) in an opening of the mixing tube.

26 Claims, 20 Drawing Sheets

U.S. PATENT DOCUMENTS

| | | | | | |
|---|---|---|---|---|---|
| 4,643,233 | A | * | 2/1987 | Manders | 139/435.4 |
| 4,958,664 | A | * | 9/1990 | Oppl et al. | 139/435.1 |
| 5,417,250 | A | * | 5/1995 | Markey | 139/435.3 |
| 5,526,850 | A | * | 6/1996 | Sora et al. | 139/435.4 |
| 5,697,405 | A | * | 12/1997 | Dornier et al. | 139/435.4 |
| 6,109,309 | A | * | 8/2000 | Dornier et al. | 139/435.3 |
| 6,119,733 | A | | 9/2000 | Arndt et al. | |
| 6,983,771 | B2 | | 1/2006 | Halvarsson et al. | |
| 7,156,337 | B2 | | 1/2007 | Halvarsson et al. | |
| 7,178,560 | B2 | | 2/2007 | Bamelis et al. | |
| 7,191,804 | B2 | | 3/2007 | Bamelis et al. | |
| 2007/0095418 | A1 | | 5/2007 | Halvarsson et al. | |

FOREIGN PATENT DOCUMENTS

| | | |
|---|---|---|
| DE | 101 07 311 | 8/2002 |
| DE | 102 44 694 | 4/2004 |
| DE | 102 57 035 | 6/2004 |
| EP | 1 389 244 | 2/2004 |
| JP | 2000-119936 | 4/2000 |
| WO | WO 02/095106 | 11/2002 |

* cited by examiner

JET-WEAVING MACHINE, PARTICULARLY AN AIR JET-WEAVING MACHINE, WITH A CLAMPING DEVICE IN THE MIXING TUBE

TITLE OF THE INVENTION

Jet-weaving machine, particularly an air jet-weaving machine, with a clamping device in the mixing tube

FIELD OF THE INVENTION

The invention relates to a jet-weaving machine, particularly an air jet-weaving machine, with a clamping device in the mixing tube for clamping a cut-off weft thread in such a way that the latter is prevented from jumping back into the mixing tube.

BACKGROUND INFORMATION

Jet-weaving machines, particularly air jet-weaving machines, belong to shuttleless weaving machines. A shuttleless weaving machine of this type is known from DE 32 00 638 A1. In this known shuttleless weaving machine, either a thread clamp is arranged in the end region of the mixing tube of a main blow nozzle mounted on the batten or, in addition to this, a further thread clamp is arranged upstream of the entry of the weft thread into the main blow nozzle. The known thread clamps are designed as an elastic intermediate piece which is inserted firmly into the mixing tube and which by means of linearly movable lifting members can clamp the weft thread essentially in the middle of the mixing tube. Furthermore, clamping devices are described which operate by means of linearly movable lifting members which are arranged with a close fit in the intermediate tube and which clamp the weft thread on an opposite wall of the mixing tube flattened in cross section in the region of the orifice of issue. The movement of the lifting members which is necessary for generating the clamping action of the thread clamps requires relatively long stroke travels, since they execute a linear movement.

Furthermore, DE 102 44 694 A1 discloses a method for holding a weft thread in the region of a main nozzle of a jet-weaving machine and a jet-weaving machine for carrying out the method. In this known jet-weaving machine, a clamping device in the form of a pneumatic muscle in the front region, that is to say the fabric-confronting outlet end of the mixing tube is described. The pneumatic muscle described is acted upon with compressed air from outside, with the result that its walls are pressed toward the middle of the mixing tube, in which region the weft thread to be clamped is located. The weft thread is thereby clamped approximately in the region of the longitudinal axis of the mixing tube.

Furthermore, a weft-thread tensioning device for a main nozzle device of an air jet-weaving machine is known from DE 102 57 035 A1. In this known air jet-weaving machine, in each case a thread clamp is arranged upstream of the main nozzle device and downstream of the main nozzle device in the region of the end of the mixing tube. On the one hand, the clamping device described is activated by linearly movable actuators, for which relatively long stroke travels are required in order to implement the clamping movement. On the other hand, the disadvantage of clamping the weft thread even upstream of the main nozzle is that clamping imparts to the weft thread a pinch which no longer readily comes loose in the case of specific materials after the insertion of the weft thread, so that this clamping can be detected at least visually in the finished fabric. In order to avoid clamping traces of this kind being visible in the finished fabric, a relatively large amount of waste, that is to say the end to be cut off from the weft thread, would have to be taken into account. This, however, would result in a relatively high loss of material.

Finally, a device for holding the weft thread at the exit of the mixing tube of a main blow nozzle is known from JP 2000119936.

The clamping surface of a clamping lever loaded, for example, by a spring engages into a longitudinal groove present on the end face in the mixing tube and at the same time takes effect positively on an abutment likewise present on the end face of the mixing tube. The weft thread is in this case clamped between the clamping surface and the abutment.

The clamping lever is designed in such a way that the air stream of the main blow nozzle which transports the weft thread acts upon the clamping lever counter to the action of its clamping force and opens and in this case at the same time releases the weft thread clamped between the clamping surface and abutment.

An individual control of the clamping or holding device is not possible.

SUMMARY OF THE INVENTION

The object on which the invention is based is, therefore, to design a jet-weaving machine, particularly an air jet-weaving machine, with a device for the controlled clamping of a weft thread in a mixing tube of a main nozzle, by means of which device short travels of the clamping member and therefore also relatively low effort for executing the movement of the clamping member become possible.

This object is achieved by means of a jet-weaving machine, particularly an air jet-weaving machine, having the features according to the present invention as disclosed and as claimed herein.

According to the invention, the jet-weaving machine, preferably an air jet-weaving machine, has a main blow nozzle having a mixing tube for inserting a weft thread into a shed by means of a transport fluid expelled from the main blow nozzle. Depending on the number of different colors or materials of weft threads which are to be interwoven, preferably up to eight main blow nozzles with respective mixing tube are provided in the jet-weaving machine according to the invention. The main blow nozzle preferably arranged on the batten and having a mixing tube has a single clamping device in the region of its weft thread outlet. This clamping device is of small, that is to say compact, design and has an actuator arranged outside the mixing tube and a lever connected to said actuator. The lever is connected to the actuator in such a way that the latter, when acted upon by an actuation means, which may preferably be a hydraulic, pneumatic or electric means, executes a tilting movement. With a correspondingly long lever, it can consequently be ensured that, when the actuator is acted upon by the actuation means, even relatively minor deformations of the actuator lead to relatively long movement travels of that end of the lever which is remote from the actuator. It is also possible, however, that action upon the actuator by actuation means during which the lever is in a non-clamping position is interrupted, so that, when action upon the actuator is interrupted or discontinued, the lever executes the required tilting movement, in order to move out of the non-clamping position into its clamping position. In the region at the end of the mixing tube, the latter is provided with an orifice. The lever has a length and form such that, when it executes its tilting movement in this orifice of the mixing tube, it clamps the weft thread between itself and an abutment.

An essential advantage of this design according to the invention of the clamping device is that relatively high travels can be generated via the length and form of the lever, without the actuators requiring major deformations generating the tilting movement of the lever. It is thereby possible that the clamping device can be designed in structural terms with relatively small dimensions. Particularly in the case of jet-weaving machines which are provided with up to eight main blow nozzles with respective mixing tube, arranged in a block, the small dimension of the clamping device is of great importance. On the one hand, the main blow nozzles and associated mixing tubes can be arranged closely next to one another in the block, and, on the other hand, the low weight of the clamping device means that the acceleration forces occurring due to the movement of the batten and also the acceleration forces occurring due to the execution of the tilting movement are low or are lower than the pneumatic forces. Furthermore, by means of the design according to the invention of the clamping device, it is possible by an appropriate mass distribution to achieve a force equilibrium in which the accelerations occurring have no adverse influence on the clamping force or even on the clamping action.

A further advantage of the jet-weaving machine according to the invention is, in terms of its clamping device, that the clamping of the weft thread in the mixing tube can take place near its outlet orifice pointing in the direction of the fabric, so that after the weft thread has been inserted, this clamping region belongs to the waste to be cut off, and, consequently, not only is low waste generated, but also a high-quality fabric in which clamping points cannot lead to any visual impairment. Moreover, in the clamping device according to the invention, there is a low risk of contamination, since an at least slight overpressure exists in the mixing tube due to the blowing air introduced by the main blow nozzle, so that dirt particles cannot penetrate into the mixing tube in spite of the orifice in the latter. On account of the low deformations of the actuator when action upon it is applied or else discontinued and their conversion into relatively long movements of the end region of the lever which are adapted to the intended use, the stresses on the actuator are low, thus leading to a long service life of the latter.

According to a development of the invention, the actuator is designed as an elastomeric bellows, also called a concertina herein, in particular a rubber bellows or concertina, and has at least one chamber to which the actuation means or actuation medium can be applied with a defined pressure via a port or connection on the actuator. The lever is fastened with one side to the elastomeric bellows or concertina, so that the deformation of the chamber occurring due to the actuation means or medium causes a tilting or pivoting movement of the lever. The tilting or pivoting movement of the lever at its end which lies opposite the end at which it is fastened to the actuator is in this case at least such that the preferably angled end region of the lever penetrates into the orifice of the mixing tube, presses against the abutment and with its end clamps the weft thread between itself and the abutment.

Preferably, the actuator of the clamping device of the jet-weaving machine according to the invention has two chambers, at least one of which can be acted upon by the actuation means. The lever is connected to the actuator in the region between the chambers, preferably on a wall separating the two chambers, the lever experiencing a tilting movement due to the deformation resulting from action upon the chamber. It is also possible, however, that both chambers can be acted upon by the actuation means, and action is taken by the actuation means, depending on whether the lever is to be transferred into the non-clamping position or into the clamping position.

Preferably, the lever is additionally fastened to the mixing tube by means of a spring element which is mounted between the lever and the mixing tube such that, when the actuator is acted upon by the actuation means, said spring element is stretched into a clamping position due to the tilting movement of the lever, whereas, when action upon the actuator by the actuation means is discontinued, by means of its return force, that is to say the return force of the spring element, the lever is moved out of the clamping position into its non-clamping position. The advantage of the additional spring element is that the actuator needs to be acted upon by actuation means only such that the tilting movement takes place in one direction. This means that the tilting movement takes place either in the direction of and into the non-clamping position or in the direction of and into the clamping position. The respective movement out of the position into the position previously assumed in this case takes place by means of the spring element. Preferably, the lever is in this case designed such that it is longer than the distance of the actuator from the orifice in the mixing tube, and the spring element is mounted at that end of the lever which is mounted opposite the end executing the actual clamping of the weft thread.

According to a development of the invention, the lever is plugged or adhesively bonded or vulcanized onto the actuator. The lever is in any event mounted on the actuator such that, when acted upon by the actuation means, the lever is set in a tilting or pivoting movement, but is connected on or to the actuator so firmly that the movement of the batten does not lead to an unintentional release or loosening of the lever from the actuator.

Preferably, the actuation means for the actuator is the transport fluid, preferably air. The advantage of using the transport fluid itself as actuation means is that only one fluid needs to be used in order to cause the deformation of the actuator for the execution of the tilting movement of the lever.

Preferably, the actuation means is supplied to the actuator under overpressure or underpressure. It is also possible, however, to operate both with overpressure and with underpressure in action upon the actuator. For this purpose, it is necessary merely to provide a corresponding arrangement of valves controlled accordingly by means of a control device. Particularly when two or more chambers of the elastomeric concertina are used, it is possible to act upon one chamber of the actuator with overpressure of the actuation means in order to move the lever in one direction and to act upon the other chamber of the actuator with underpressure in order to move the lever in the opposite direction. Preferably, an appropriate pump is provided for action with overpressure and an appropriate vacuum pump for action with underpressure.

Preferably, the respective actuators can be acted upon by the actuation means via at least one separate pump and controllable valves. The pump and valves are controllable by means of a control device such that the clamping device clamps the weft thread, after the latter has been cut off, on the abutment such that it can be prevented from jumping back into the mixing tube, particularly in the case of elastic or highly elastic threads.

Preferably, the clamping device of the jet-weaving machine according to the invention is designed such that the lever penetrates into the orifice of the mixing tube in order to move into its clamping position and presses with the end of the lever against the abutment in order to clamp the weft thread. It is also possible, however, that the lever has an eye or is of stirrup-shaped design at its end with which the clamping of the weft thread is to take place, the weft thread being led through the stirrup or the eye, moves in the direction out of the orifice of the mixing tube in order to move into its clamping position and, to clamp the weft thread, pulls the latter against the abutment with that end of the lever by means of which clamping takes place.

According to a development of the invention, the actuator of the clamping device of the jet-weaving machine according to the invention is designed as a piezoelectric element. Since the lever executes a tilting movement for the direct clamping of the weft thread on the abutment and consequently the movement travels of the actuator which are required for implementing the tilting movement can be kept small, depending on the lever length, it is possible also to use a piezoelectric element as actuation means for the actuator. The relatively large movement travels required in the clamping devices according to the prior art as a result of their linear movement allow the use of piezoelectric elements there, at most, only extremely restrictively. A further advantage of the use of piezoelectric elements as actuation means is that lines for supplying the actuator with an actuating means in the form of a fluid, as a gaseous or liquid medium, may be dispensed with, and only relatively easily layable electric junction lines are required. The activation of the piezoelectric element by means of current has the advantage, furthermore, that leaks of the supply fluid, that is to say of the actuation means, cannot occur.

Preferably, the piezoelectric element is designed as what is known as a stack block or as a flexural converter and is connected to the lever such that the lever executes the tilting movement when a current is applied to the piezoelectric element. A stack block, as it is known, consists of a plurality of layers of piezoelectric elements, to which the current is equally applied such that the stack block is inclined on one side and that the generatable movement travel to be utilized is added up according to the number of individual elements. The piezoelectric element in the form of a flexural converter is in this case arranged on the longer leg of a preferably angled lever, the piezoelectric flexural converter and the lever being dimensioned such that, when the current is applied to the piezoelectric element, the leg which is intended to clamp the weft thread on the abutment can penetrate into the orifice of the mixing tube and clamp the weft thread on the abutment.

According to a further development of the invention, the orifice in the mixing tube is so formed or so designed that the mixing tube is subdivided into a first and a second portion, the first portion carrying the actuator with the lever. The second portion is designed to be markedly shorter than the first portion and with its end directed toward the fabric forms the outlet orifice of the mixing tube. The mixing tube is consequently divided in two, the abutment being mounted below the orifice and thus connecting the first and the second portion of the mixing tube to one another. The abutment may be mounted on the opposite side of the orifice on which the lever begins to penetrate into the orifice. The abutment may preferably be adhesively bonded or otherwise attached with firm adhesion to the two portions of the mixing tube. Preferably, the abutment has an increased friction factor, so that the weft thread, when clamped by the lever in its clamping position, can be held reliably. The second portion of the mixing tube designed to be markedly shorter than the first portion has, in terms of its function, the advantage that it avoids the situation where the free end of the weft thread, after the latter has been cut off after its insertion in the region of the outlet orifice of the mixing tube, cannot collide with the clamp and does not beat back into the shed after its insertion. By the mixing tube being divided in two, a decoupling of the clamp from the thread end thus takes place.

It is also possible that the abutment connects the two portions of the divided mixing tube to one another on the top side of the latter, and the lever engages with its end causing the clamping and having an eye through the abutment and brings about the clamping of the weft thread in that the weft thread running through the eye is pulled against the abutment (clamping position).

According to a development of the invention, in a jet-weaving machine which is provided for a multicolor fabric, the main blow nozzles together with their mixing tubes are combined into a block having up to eight main blow nozzles and respective mixing tubes. In this block, preferably, in each case two mixing tubes lying directly next to one another are provided on each of their sides facing away from one another with an actuator having a lever, that is to say the mixing tubes carry an actuator having a lever on each of their sides facing away from one another, that is to say in a 180° arrangement. Preferably, these two actuators are combined into a modular unit, that is to say in pairs. Preferably, the modular unit is a frame-shaped design and consequently surrounds the two actuators with their corresponding levers. It is consequently possible to provide four such modular units, each with a pair of actuators and associated levers, in the direct outlet orifice region of the mixing tubes, without the individual mixing tubes having to be arranged far apart from one another due to the arrangement of the actuator and lever. The compact arrangement of the number of mixing tubes has the advantage that the respective colors or various materials of weft threads can easily be inserted into the shed in spite of the multiple arrangement.

BRIEF DESCRIPTION OF THE DRAWINGS

Further advantages, features and possibilities of use of the present invention are explained in detail with reference to exemplary embodiments and to the accompanying drawing in which.

DETAILED DESCRIPTION OF EXAMPLE EMBODIMENTS OF THE INVENTION

Figure 1:
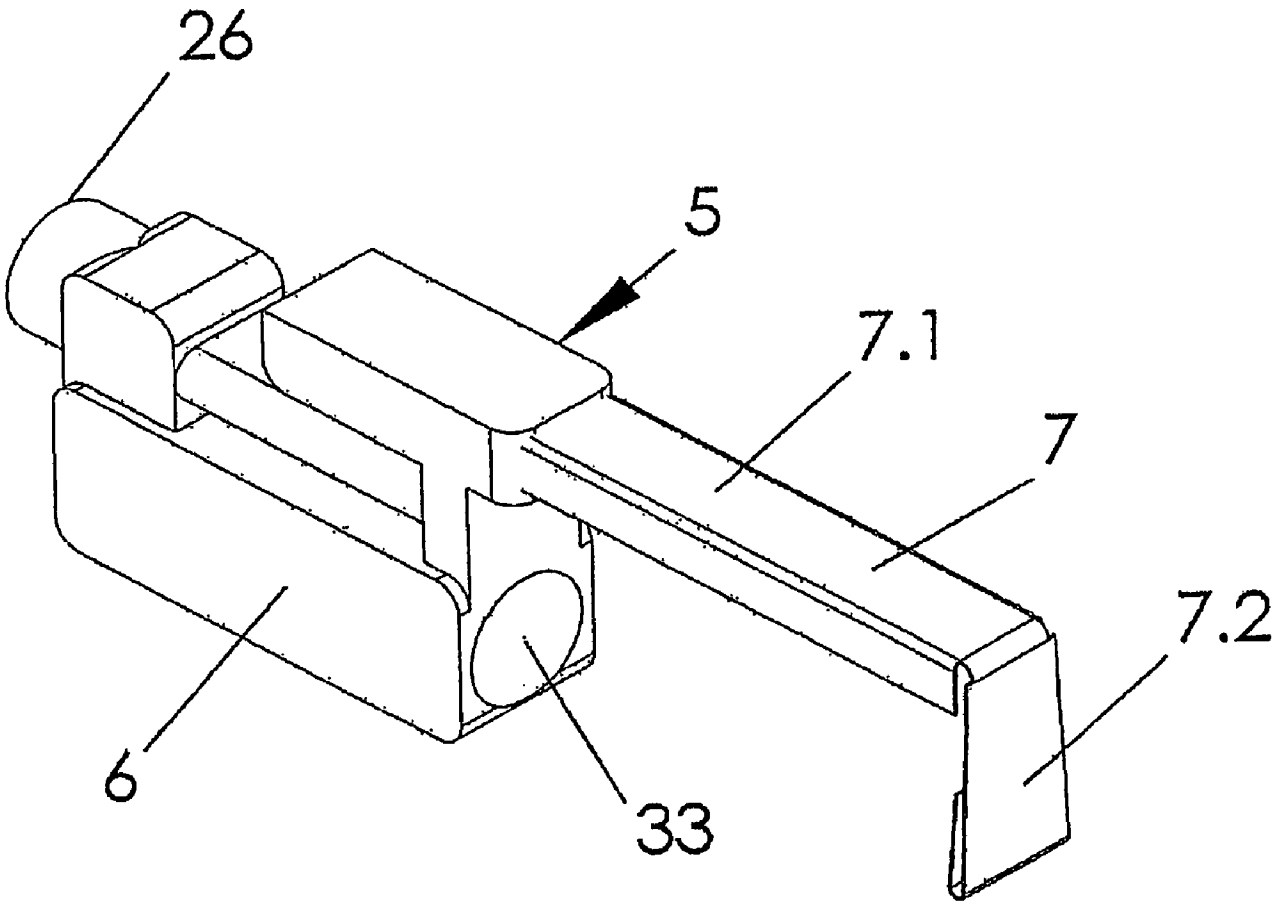
FIG. 1 shows a basic view of a clamping device according to a first exemplary embodiment of the invention with actuator and lever in the assembled state.

FIG. 1 illustrates an essential part of the clamping device 5 in the preassembled state. An elastomeric bellows or concertina designed as a hollow profile forms the actuator 6 which can be supplied with actuation means or actuation medium such as compressed air via a connection or port 26. A lever 7 with a long leg 7.1 and with a short leg 7.2 is plugged at its end with the long leg 7.1 onto the actuator 6 by means of a profiling, not designated. The actuator 6 itself has a passage duct 33 of circular cross section, which serves for plugging the actuator firmly onto a mixing tube (not shown). The diameter of this passage duct 33 is in this case dimensioned such that the actuator 6, after being mounted, sits firmly on the mixing tube. The angled short leg 7.2 of the lever 7 is folded at its lower end onto itself over part of its length, so that at its lower end there is a radius at which the actual clamping of the weft thread (not shown) takes place. The weft thread is clamped carefully by means of the radius at the end of the short leg 7.2.

Figure 2:
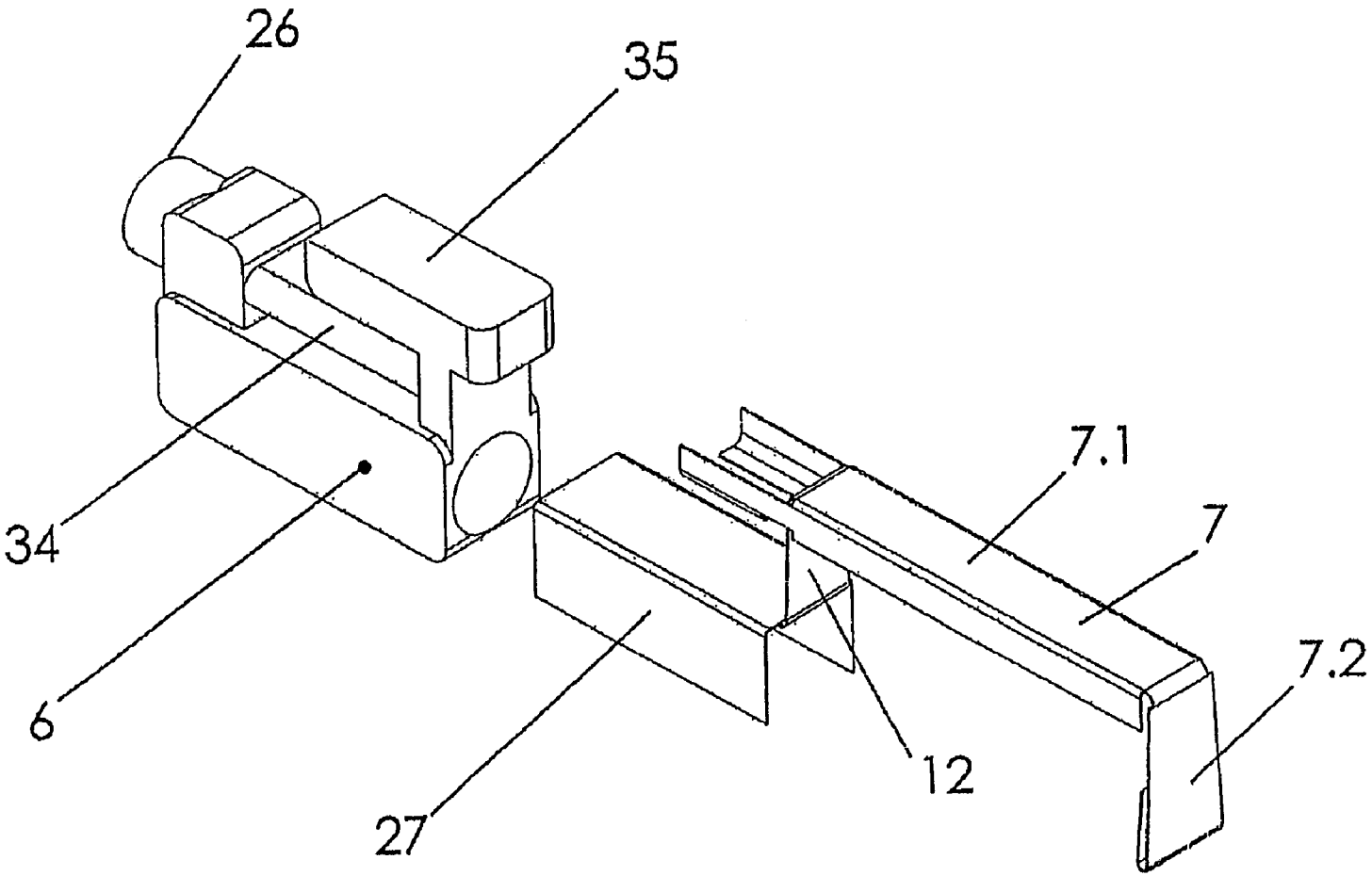
FIG. 2 shows the exemplary embodiment according to FIG. 1 in the demounted state.

FIG. 2 illustrates a basic illustration of the exemplary embodiment according to FIG. 1, but in demounted form. As described above, the actuator 6 has a connection 26 for the actuation means and is provided, furthermore, with a flat hollow profile 34 and with a lever receptacle 35. The lever 7 consists of a bent profile with a long leg 7.1 and with a short leg 7.2 angled essentially at right angles thereto. For stiffening and fastening on the actuator 6, the lever 7 has bends extending in the longitudinal direction to the long leg 7.1. By means of the short leg 7.2, the thread to be clamped is pressed carefully onto an abutment or clamping counter surface (not illustrated). At its end lying opposite the short leg 7.2, the lever has a reinforcing portion 27 of U-shaped design which can be plugged onto the actuator 6 when the lever 7 is mounted on the actuator 6 and which provides lateral stability for the actuator by means of the side legs of the U-shaped profile. The U-shaped profile is connected to the long leg 7.1 of the lever 7 via a spring element 12. When the actuator 6, in its flat hollow profile 34, transitions from its neutral pressureless state into a deformed state by action upon it with the actuation means or actuation medium such as compressed air, the flat hollow profile is expanded, with the result that the lever 7 experiences a tilting movement and the short leg 7.2 presses a weft thread in the direction toward the clamping surface formed by the abutment (not illustrated).

Figure 3:
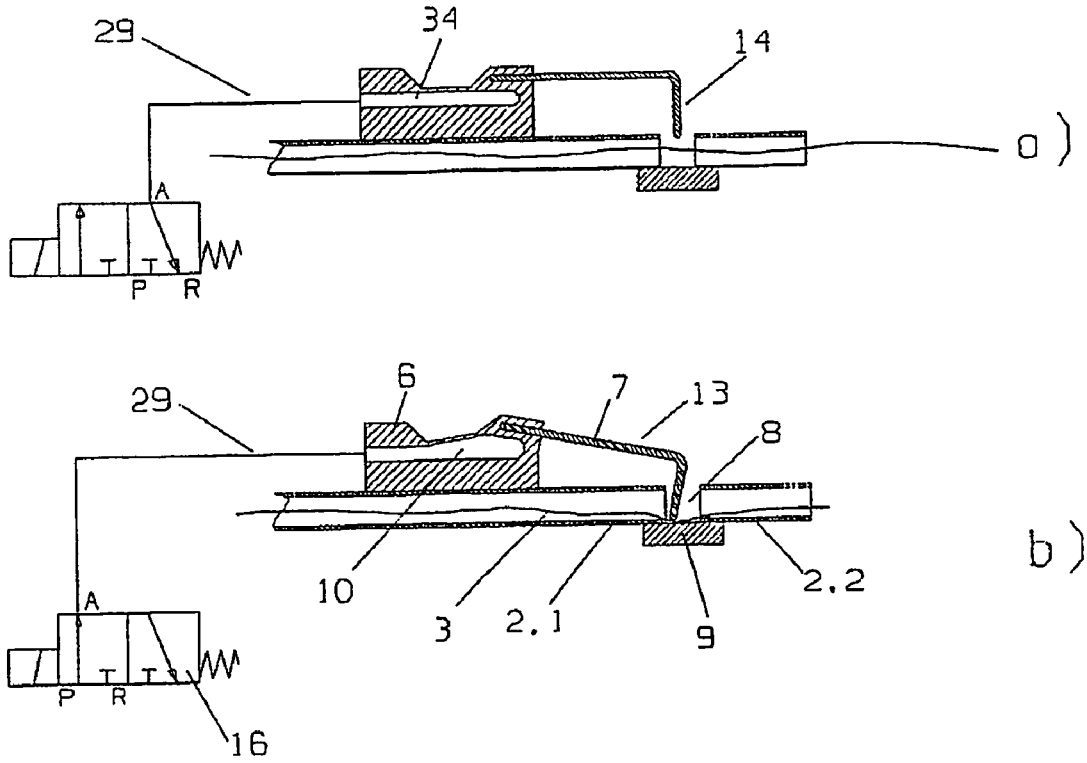
FIG. 3*a*) shows a further exemplary embodiment according to the invention, in which the non-clamping position is shown.
FIG. 3*b*) shows the clamping position for this exemplary embodiment.

In the basic illustration of the exemplary embodiment of the invention according to FIG. 3, the actuator 6 is provided with a chamber 10 which is likewise designed as a flat hollow profile 34 (see FIG. 3*a*). The lever 7 is connected to the actuator 6 by means of a plug connection. In the pressureless state, in which the supply line 29 for the actuation means is pressureless with respect to the chamber 10, the lever 7 is in the non-clamping position, that is to say has not penetrated into the orifice 8 in the mixing tube 2.

FIG. 3*b*) shows the state in which actuation means is introduced into the chamber 10 by way of the supply line 29 via a pressure source and a controlled valve 16. The chamber 10 is thereby inflated/deformed, and the webs delimiting the chamber, together with the web in which the lever 7 is plugged by means of a plug connection, experience deformation as a result. The plug connection and the webs are in this case designed such that, under deformation of the chamber 10, the lever 7 executes a tilting movement, with the result that the latter penetrates with its short leg 7.2 into the orifice 8 of the mixing tube and presses the weft thread 3 onto the abutment 9 forming the clamping surface, thus holding said weft thread with a clamping action. The mixing tube is divided by the orifice 8 into two parts, to be precise a first portion 2.1 and a second portion 2.2, which are connected to one another on their underside by means of the abutment 9. The second portion 2.2 of the mixing tube 2 is significantly shorter than the first portion 2.1 of the mixing tube. This second portion 2.2 has mainly the function of preventing the cut-off end of the weft thread 3 from colliding with the clamping device.

Figure 4:
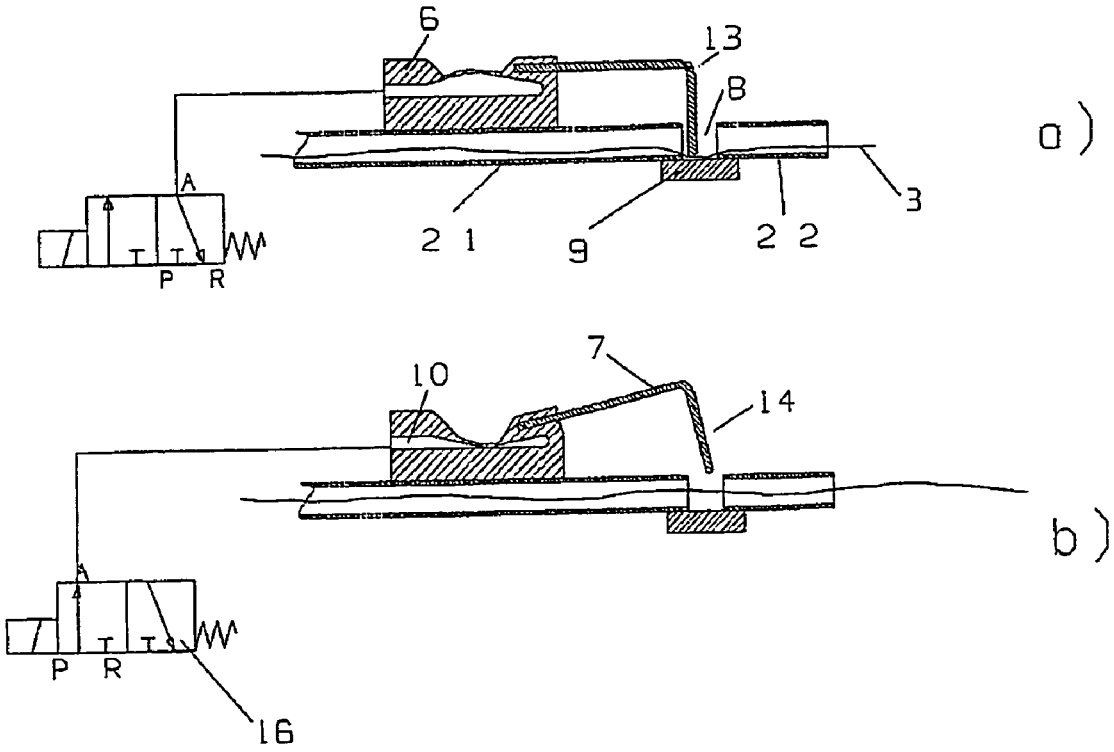
FIG. 4*a*) shows a further exemplary embodiment of the invention, in which the actuator is acted upon by underpressure, in the clamping position.
FIG. 4*b*) shows the exemplary embodiment according to FIG. 4*a*) in the non-clamping position.

In FIG. 4, an exemplary embodiment is described which is similar to that according to FIG. 3, with the difference that, instead of an overpressure, the chamber 10 is acted upon by a vacuum generated via a corresponding controllable valve by means of a vacuum pump. In the basic pressureless state (FIG. 4*a*)), the lever 7 is in this case connected to the actuator 6 such that the clamping device is in its clamping position 13. When an underpressure is applied to the chamber 10 of the actuator 6, the chamber is likewise deformed, specifically inwardly, the result of which is that the lever 7 executes its tilting movement and emerges out of the orifice 8 of the mixing tube between the two portions 2.1 and 2.2, so that this position represents the non-clamping position 14.

The exemplary embodiment according to FIGS. 5*a*) and 5*b*) corresponds in its basic set-up to that according to FIG. 4. The difference, however, is that, instead of a gaseous actuation means, a hydraulic fluid is used which is supplied to the respective chamber 10 of the actuator 6 by pumps. When the chamber 10 is acted upon by pressure, then, due to the deformation of, inter alia, the web delimiting the chamber and receiving the end of the long leg of the lever 7, a tilting movement of the lever 7 out of its non-clamping position 14 into its clamping position 13 is brought about. In the clamping position 13, the lower end of the short leg of the lever 7 presses onto the abutment 9 and reliably clamps the weft thread 3 between its lower edge and the abutment 9.

Figure 5:
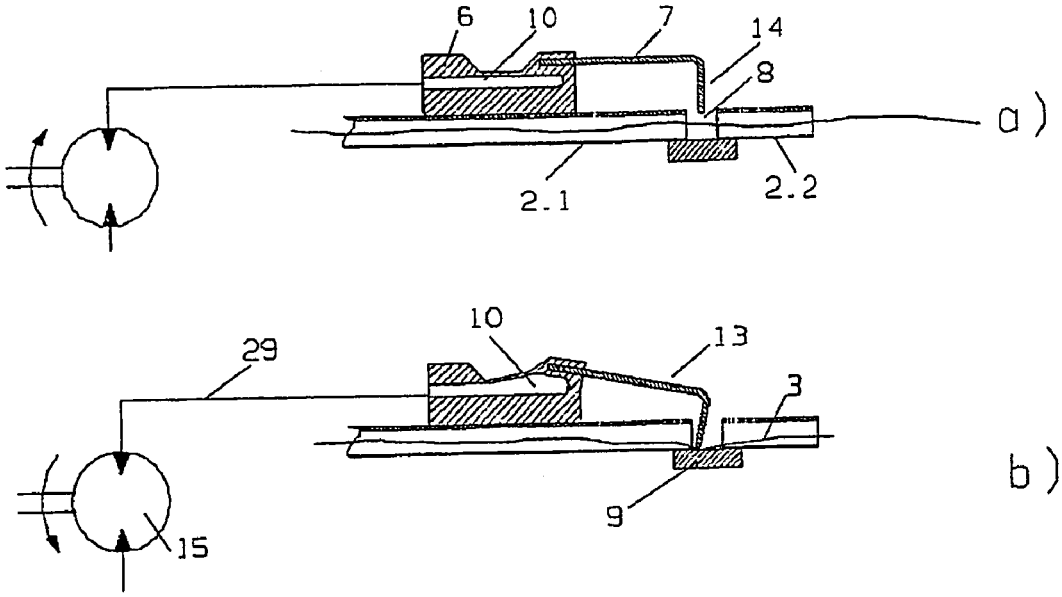
FIG. 5*a*) shows a further exemplary embodiment according to the invention, in which the actuator is acted upon by a hydraulic fluid conveyed by a pump, in the non-clamping position.
FIG. 5*b*) shows the exemplary embodiment according to FIG. 5*a*) in the clamping position.
Figure 6:
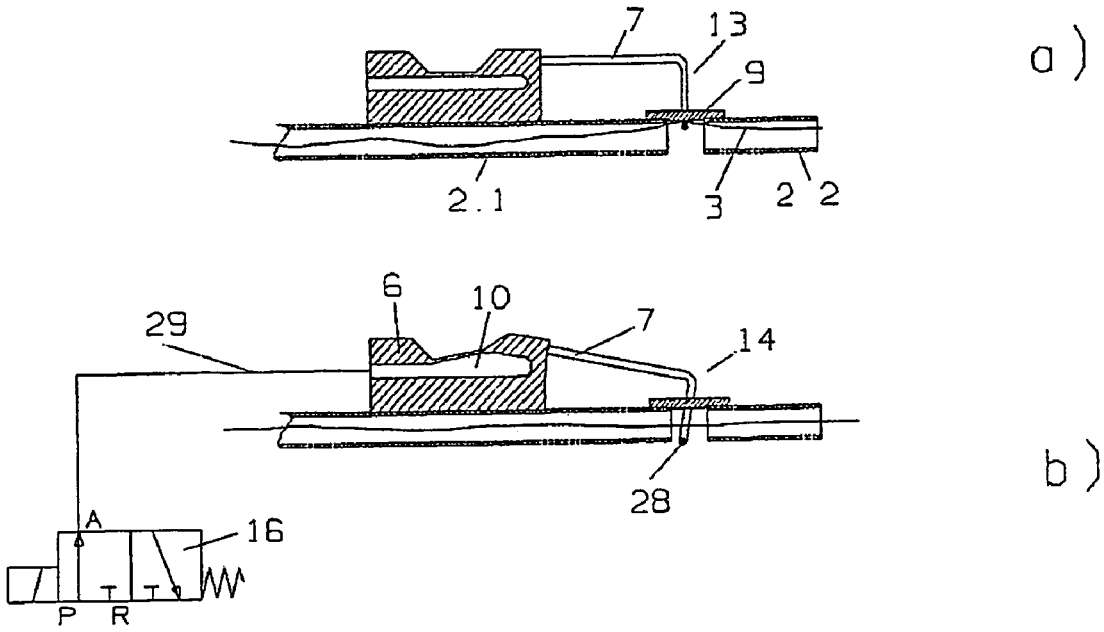
FIG. 6*a*) shows a further exemplary embodiment of the invention in which the weft thread is clamped by a pull against an abutment, in the clamping position.
FIG. 6*b*) shows the exemplary embodiment according to FIG. 6*a*) in the non-clamping position.

FIG. 6 shows a further exemplary embodiment of the invention, in which the actuator 6 has the basic set-up according to the exemplary embodiments shown in FIGS. 4 and 5, but in which the clamping action of the lever 7 on the abutment 9 is not achieved by pressure, but by the pull of the latter. For this purpose, the lever 7 is connected to the actuator 6 such that, in the pressureless state, the lever pulls the weft thread against the abutment 9 and clamps it there. The short leg of the lever 7 in this case passes through the abutment 9 which is arranged on the top side of the mixing tube subdivided into the two portions 2.1 and 2.2. That end of the short leg of the lever 7 which effects the clamping of the weft thread is designed as an eye 28 or in the form of a stirrup and has the weft thread 3 passing through it. Actuation means is introduced with overpressure into the chamber 10 of the actuator 6 from a pressure source via a controllable valve 16 and the supply line 29 for actuation means, with the result that this chamber 10 is inflated and thus deformed. Due to this deformation of the chamber 10, the web receiving the long leg of the lever 7 and delimiting the chamber 10 is deformed such that the short angled leg of the lever 7 passes with its eye 28 or its stirrup-shaped formation downward through the orifice 8 between the two portions 2.1 and 2.2 of the mixing tube, so that the weft thread 3 is released. The clamping device is thus in its non-clamping position 14.

Figure 7:
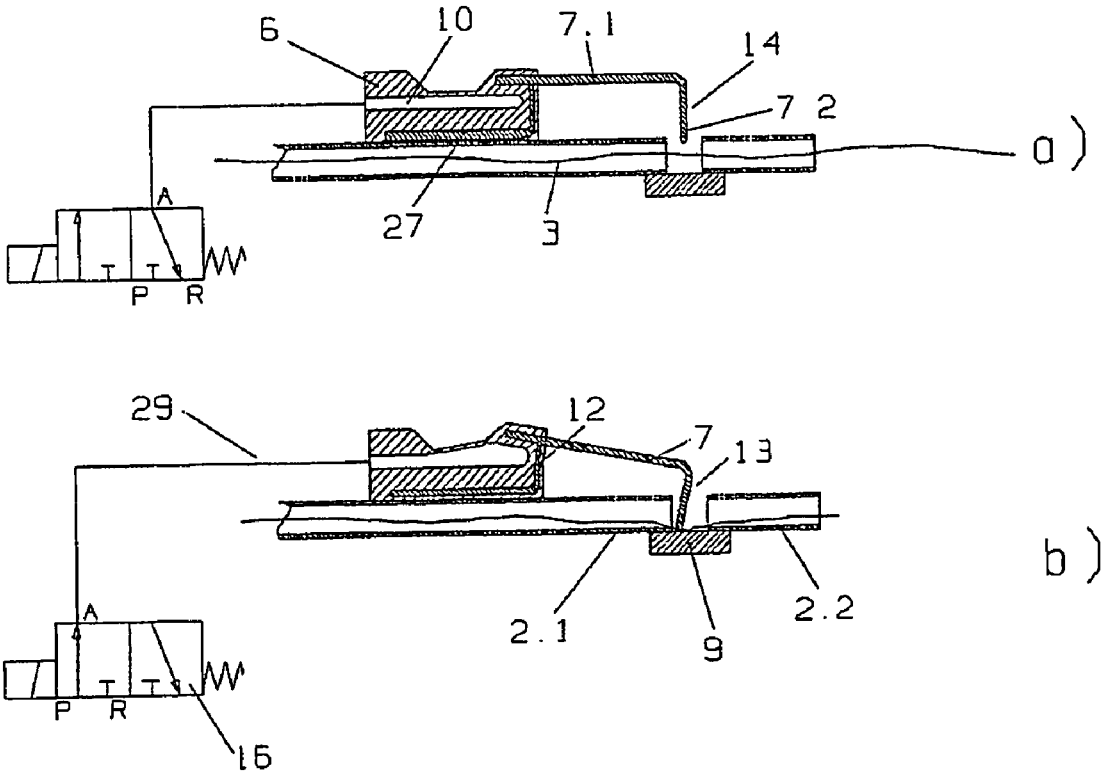
FIG. 7*a*) shows a further exemplary embodiment of the invention with a reinforcing portion of the lever in the actuator, in the non-clamping position.
FIG. 7*b*) shows the exemplary embodiment according to FIG. 7*a*) in the clamping position.

FIG. 7 shows a further exemplary embodiment of the invention, in which there is no separate spring element provided for the lever 7, but, instead, the spring element is arranged in the lever itself or between its reinforcing portion 27 and its long leg 7.1, so that the lever consists of a short leg 7.2, a long leg 7.1, a spring element 12 and a reinforcing portion 27, all the parts being connected integrally with one another or to another. Both the long leg 7.1 of the lever 7 and the spring element 12 and also the reinforcing portion 27 are arranged in the elastomerically designed actuator 6. The elastomeric actuator 6 has a chamber 10 which, when the actuation medium is acted upon with overpressure by the valve 16 which is a 2/4-way valve, leads to a deformation of the elastomeric actuator 6, with the result that the lever 7 is brought by means of a tilting movement out of its non-clamping position (see FIG. 7*a*)) into the clamping position according to FIG. 7*b*). The force which is generated by the pressure of the actuation means and consequently by the deformation of the elastomeric actuator 6 is in this case higher than the spring force of the spring element 12, the spring force of which has to be overcome during the deformation of the elastomeric actuator 6, in order to bring the lever 7 from the non-clamping position 14 into the clamping position 13. In the clamping position 13, due to the deformation of the elastomeric actuator, the short leg 7.2 has penetrated into the orifice 8 of the mixing tube consisting of the portions 2.1 and 2.2, with the result that the weft thread 3 is pressed against and onto the abutment 9 in order to be clamped. When the controllable valve 16 is displaced to the left into its second position in FIG. 7 and consequently the pressure in the chamber 10 of the actuator 6 is equal to the ambient pressure, the force of the spring element 12 brings about a tilting movement out of the clamping position 13 back into the non-clamping position 14, without, additionally, either vacuum being applied to the chamber 10 or a second chamber having to be provided which would then likewise have to be acted upon by the actuation means counter to the action of the first chamber 10. The actuation means passes from the controllable valve 16 via the supply line 29 for the actuation means into the chamber 10 and, in the event of a pressure higher than the ambient pressure, causes the deformation, illustrated in FIG. 7*b*), of the elastomeric actuator.

Figure 8:
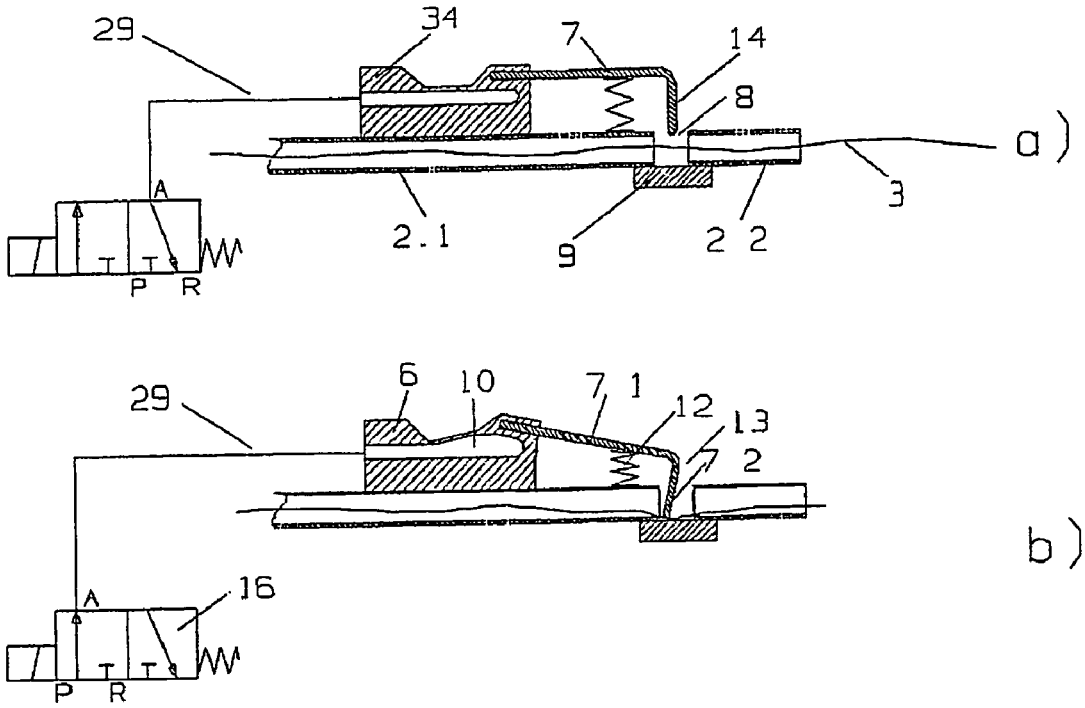
FIG. 8*a*) shows a further exemplary embodiment according to the invention, in which the lever of the clamping device is supported with respect to the mixing tube by means of a spring element, in its non-clamping position.
FIG. 8*b*) shows the exemplary embodiment according to FIG. 8*a*) in the clamping position.

FIG. 8 illustrates an exemplary embodiment which is similar to that of FIG. 7. The lever 7 is in this case markedly simplified in terms of its set-up, as compared with that illustrated in FIG. 7, and has only one long leg 7.1 and one short leg 7.2. The long leg 7.1 of the lever 7 is fastened, preferably vulcanized or glued, with one end in the elastomeric actuator 6 designed as a flat hollow profile 34. The fastening of this end of the long leg 7.1 in this case takes place such that, under deformation of the elastomeric actuator 6 as a result of the action of pressure by the actuator means via the valve 16 and the supply line 29 into the chamber 10, the latter is deformed, and, consequently, counter to the action of the force of the spring element 12, the lever 7 penetrates, executing a tilting movement, with its short end 7.2 into the orifice 8 of the mixing tube consisting of the portions 2.1 and 2.2. Due to penetration, the weft thread 3 is pressed against the abutment 9 and is thus clamped there. After the actuation means in the chamber 10 is set at a pressure equal to the ambient pressure, which may also be achieved, for example, in that the valve 16 is switched into a non-passage position, the force of the spring element 12 overshoots the deformation force of that part of the elastomeric actuator 6 which carries the end of the long leg 7.1 of the lever 7, so that, as a result of the force of the spring element 12, the lever executes a tilting movement out of the clamping position 13 according to FIG. 8*b*) into the non-clamping position 14 according to FIG. 8*a*).

Figure 9:
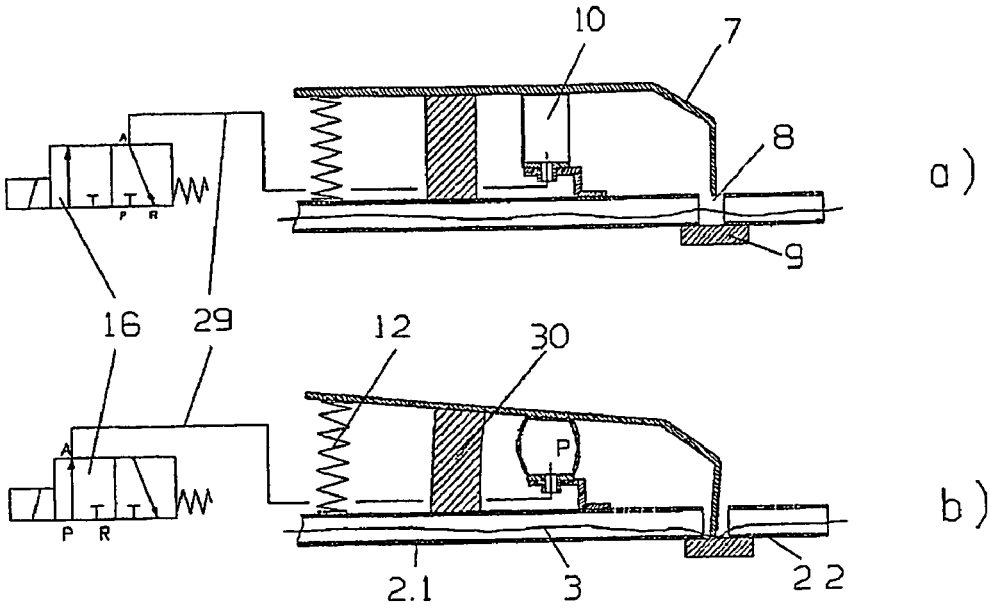
FIG. 9*a*) shows a further exemplary embodiment according to the invention, with a pneumatically loaded elastomeric bellows or concertina, spring element and flexural support, in the non-clamping position.
FIG. 9*b*) shows the exemplary embodiment according to FIG. 9*a*) in the clamping position.

FIG. 9 illustrates a further exemplary embodiment of the invention, in which, in addition to a chamber 10 which can be acted upon by the pressure of the actuation means, in order thereby to bring about a tilting movement of the lever 7, and to a spring element 12 arranged next to the end of the long leg 7.2 of the lever 7, a flexural element 30 is additionally provided. Between the short leg 7.2 of the lever 7 and the flexural element 30 is arranged the chamber 10 which is acted upon by the actuation means via a supply line 29. In the non-clamping position 14 illustrated in FIG. 9*a*), the controllable valve 16 is in its shut-off position, so that actuation means is not passed through, and consequently the chamber 10 is not acted upon by actuation means. In the clamping position 13 illustrated in FIG. 9*b*), by the action of pressure upon the chamber 10 by the actuation means the said chamber is deformed, so that a deformation-induced shortening occurs due to the fact that its longitudinal axis is arranged essentially perpendicularly to the long leg 7.1. Owing to this shortening of the longitudinal extent of the chamber 10, the angled short leg 7.2 of the lever 7 is tipped into the orifice 8 between the first portion 2.1 and the second portion 2.2 of the mixing tube, with the result that a clamping of the weft thread 3 on the abutment 9 takes place. The abutment 9 in this case connects the first portion 2.1 to the second portion 2.2 of the mixing tube. The elastomeric actuator with only one chamber 10 is arranged at right angles to the longitudinal orientation of the main nozzle. A flexural element in the form of a flexural joint, preferably consisting of elastomer, causes a tilting of the lever 7 in the event of action of pressure upon the chamber 10. When the action of pressure upon the chamber 10 changes over, due to the variation in the position of the valve 16, out of its position shown in FIG. 9*b*) into the position shown in FIG. 9*a*), the force of the spring element 12 pulls on the long leg 7.1 of the lever and thus tilts the latter back into the non-clamping position 14 again, as illustrated in FIG. 9*a*).

Figure 10:
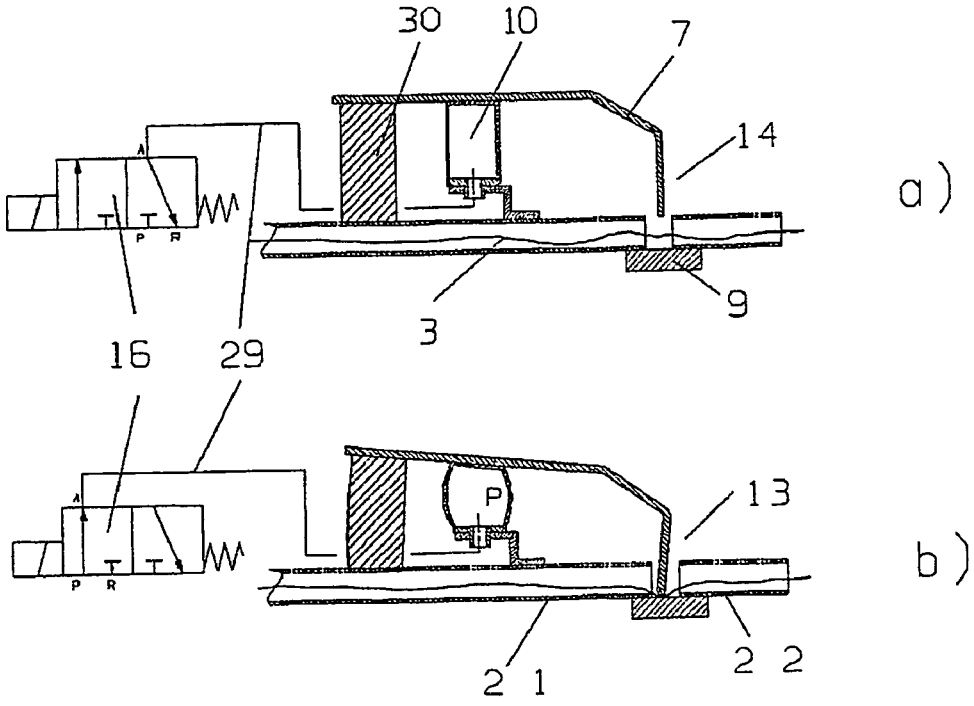
FIG. 10*a*) shows an exemplary embodiment according to FIG. 9, in which the flexural element is designed at the same time as a spring element, in the non-clamping position.
FIG. 10*b*) shows the exemplary embodiment according to FIG. 10*a*) in the clamping position.

An exemplary embodiment similar in its functioning to the exemplary embodiment according to FIG. 9 is shown in FIG. 10. The only difference is that the additional spring for tilting the lever 7 back into the non-clamping position 14 is dispensed with. The elastic spring element and the flexural element 30 are in this case combined into a single element, so that the return force of the spring element is applied by the elastic flexural element 30. Functioning and set-up are otherwise the same as in the exemplary embodiment according to FIG. 9.

Figure 11:
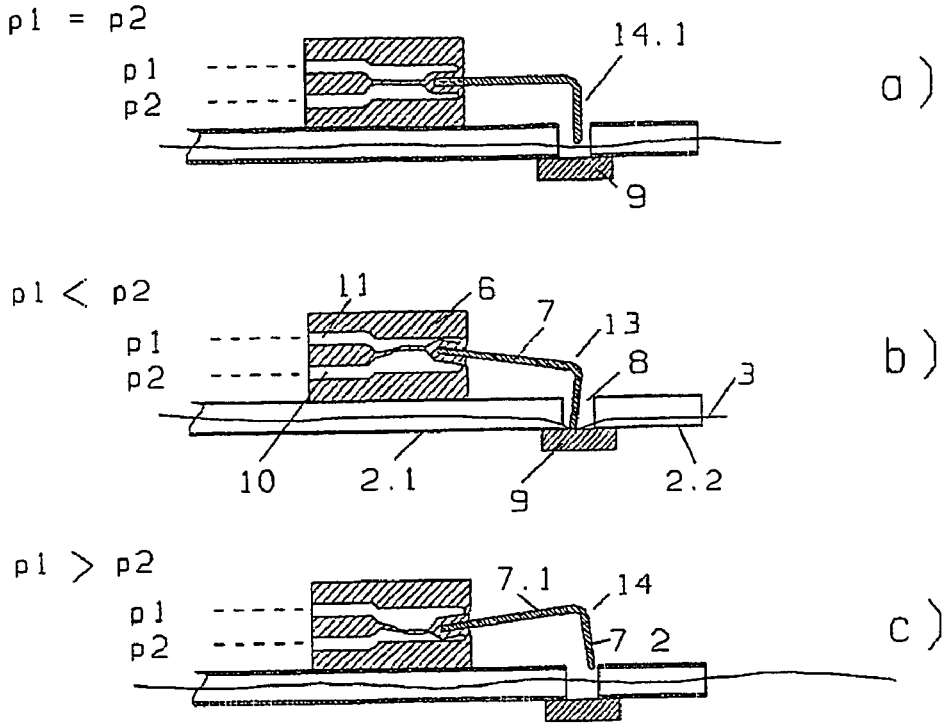
FIG. 11*a*) shows a further exemplary embodiment of the invention, in which the actuator has two chambers which can be acted upon differently by actuation means, in a non-clamping position of the lever in which the latter penetrates halfway into an orifice of the mixing tube.
FIG. 11*b*) shows the exemplary embodiment according to FIG. 11*a*) during the action of pressure upon a chamber, in the clamping position.
FIG. 11*c*) shows the exemplary embodiment according to FIG. 11*a*) during the action of pressure upon the other chamber and with the lever emerged out of the orifice of the mixing tube, in the non-clamping position.

FIG. 11 illustrates yet a further exemplary embodiment according to the invention, in which the elastomeric actuator 6 has two chambers 10, 11 capable of being acted upon by actuation means. The lever 7 is in this case fastened in the actuator 6 in a web between the chambers 10 and 11, specifically with one end of its long leg 7.1. Its short leg 7.2 is arranged essentially at right angles to the long leg and is intended to penetrate into the orifice 8 between the first portion 2.1 and the second portion 2.2 of the mixing tube and to clamp the weft thread 3 against the abutment 9. Contrary to the exemplary embodiments described hitherto, there is, in addition to the clamping position 13 and the non-clamping position 14, in which the lever has emerged completely with its short leg out of the orifice 8 of the mixing tube, also a further non-clamping position 14.1, in which the lever has penetrated with its short end only partially into the orifice 8 of the mixing tube, but does not yet clamp the weft thread 3. Such a state is illustrated in FIG. 11*a*), in which the pressure in the chamber 10 is equal to that in the chamber 11. In the event of such a pressure equilibrium ($p_1=p_2$), the actuator 6 experiences no deformation with respect to the end of the lever with which it is fastened in the actuator. The lever 7 and the actuator 6, then, are dimensioned or arranged on the mixing tube such that, with the actuator 6 not deformed, the short leg 7.2 of the lever 7 penetrates only partially into the orifice 8 of the mixing tube. If, then, the transfer of the lever 7 out of the partially penetrated non-clamping position 14.1 into the clamping position 13 is to be achieved, this may take place, for example, in that the chamber 10 is acted upon by a pressure of the actuation means which is higher than the pressure of the actuation means in the chamber 11 ($p_2>p_1$). As a result, the web which is located between the chambers 10, 11 of the actuator 6, in which the lever 7 is fastened is deflected upward, the consequence of this being that the lever 7 experiences a tilting movement, penetrates with its short leg 7.2 into the orifice 8 between the first portion 2.1 and the second portion 2.2 of the mixing tube and reliably clamps the weft thread on the abutment 9 (see FIG. 11*b*). If the lever is to be transferred into the non-clamping position 14 from the clamping position 13 and emerge completely out of the mixing tube, so that the run of the weft thread 3 in the mixing tube is entirely uninfluenced by the angled end (short leg) of the lever 7, this can be achieved in that the chamber 11 is acted upon by a pressure which is higher than the pressure of the actuation means in the chamber 10 ($p_1>p_2$). This state is illustrated in FIG. 11*c*). Although the set-up of the elastomeric actuator 6 with two chambers 10, 11 is somewhat more complex than in the case of an actuator with a single chamber, an actuator with two chambers nevertheless has the advantage that work can be carried out, where appropriate, with a non-clamping position 14.1 and therefore with less pressure of the actuation means than in the case of an actuator with a single chamber, because, in the former instance, the travels of the tilting movement of the lever 7 are lower.

Figure 12:
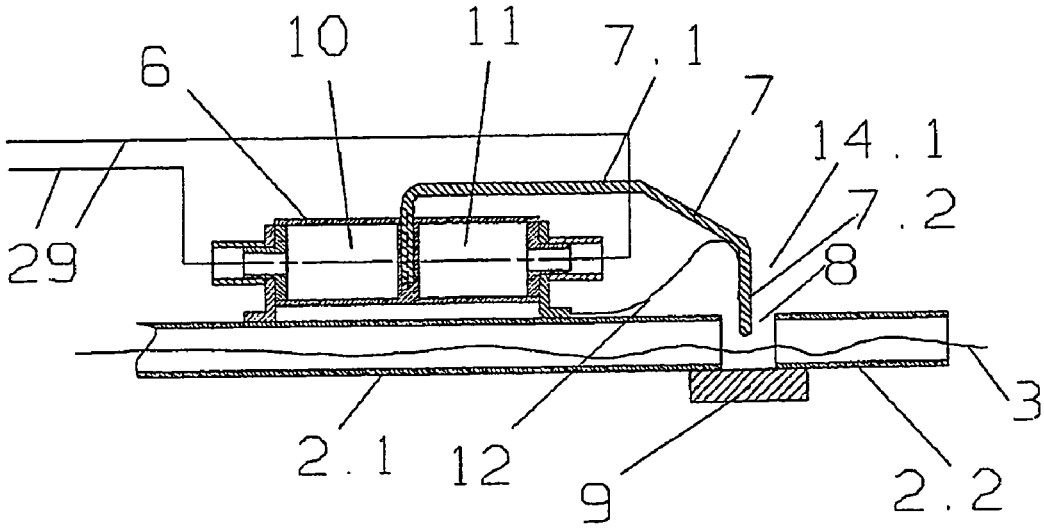
FIG. 12 shows a further exemplary embodiment according to the invention with two chambers of the actuator which are arranged one behind the other in the longitudinal direction of the mixing tube, with a portion of the lever engaging into an intermediate wall between the chambers and with a spring element between the angled short leg of the lever, in the non-clamping position.

A further exemplary embodiment according to the invention is illustrated in FIG. 12. According to this exemplary embodiment, the actuator 6 has two chambers 10, 11 which are arranged one behind the other in the longitudinal direction and which are separated by an intermediate wall, not designated. The two chambers 10, 11 can be acted upon separately by the actuation means via supply lines 29. The lever 7 is fastened with an additionally angled end of the long leg 7.1 into the intermediate wall between the chambers 10, 11. The short leg 7.2 is doubly angled, the short part of the short leg 7.2, which is intended directly for clamping the weft thread 3 in the mixing tube, is arranged essentially perpendicularly to the long leg 7.1, an approximately 45' intermediate region of the short leg being provided. On the inside, confronting the actuator 6, of the short leg 7.2 of the lever, a spring element 12 is provided which is in the form of spring sheet steel and counter to which the tilting movement of the lever 7 has to be achieved via a deformation either of the chamber 10 or of the chamber 11. In the neutral position of the lever 7 according to FIG. 12, the short leg 7.2 has penetrated partially into the orifice 8 between the first portion 2.1 and the second portion 2.2 of the mixing tube (similar to the position described in FIG. 11*a*)). Clamping itself takes place on the abutment 9, as in the other exemplary embodiments, too, the preferably rounded end of the short leg 7.2 of the lever 7 pressing the thread against the abutment 9 and clamping it reliably there.

The partially penetrated position of the lever 7 represents the non-clamping position 14.1. By the directed action of pressure upon the respective chamber 10, 11, both the opening and the closing of the clamping device can be activated in a defined way.

Figure 13:
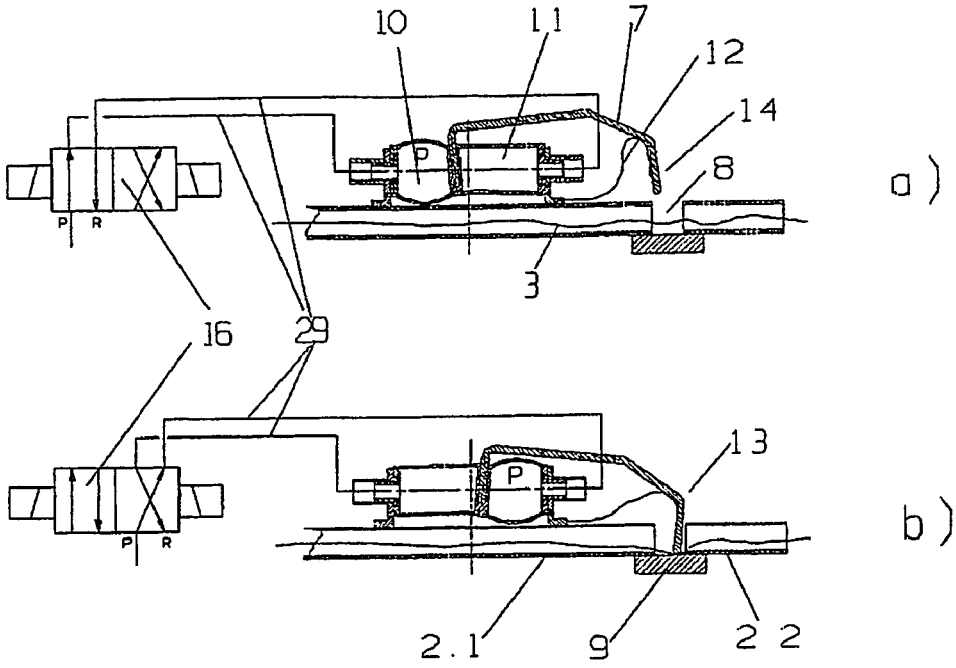
FIG. 13*a*) shows the exemplary embodiment according to FIG. 12 during action of pressure upon one chamber and with the lever moved completely out of the orifice of the mixing tube, in the non-clamping position.
FIG. 13*b*) shows the exemplary embodiment according to FIG. 12 during action of pressure upon the other chamber, in the clamping position.

FIG. 13 shows the two positions, non-clamping position 14 and clamping position 13, for the exemplary embodiment according to FIG. 12. In FIG. 13*a*), the first chamber 10 is acted upon by an increased pressure of the actuation means, a 4/2-way valve being present as a controllable valve 16. Due to the action of pressure upon the chamber 10 by actuation means, this chamber is deformed into a virtually barrel-shaped form, with the result that its longitudinal extent is shortened. This leads at the same time to a lengthening of the longitudinal extent of the chamber 11, the overall result of this being that, counter to the action of the force of the spring element 12, the lever 7 is tilted completely out of the orifice 8 of the mixing tube, and consequently the non-clamping position 14 is assumed. What is achieved by the 4/2-way valve 16 simply being changed over to its second position is that actuation means is introduced with an increased pressure into the chamber 11, whereas the chamber 10 remains pressure-free. The chamber 11 thereby assumes an essentially barrel-shaped form, thus leading to a shortening of its longitudinal extent and a simultaneous lengthening of the chamber 10. Due to this deformation, the lever 7 is tilted into the orifice 8, penetrates into the orifice 8 in the mixing tube between the first portion 2.1 and the second portion 2.2 and presses the weft thread 3 against the abutment 9 and thus clamps said weft thread reliably (see FIG. 13*b*)).

Figure 14:
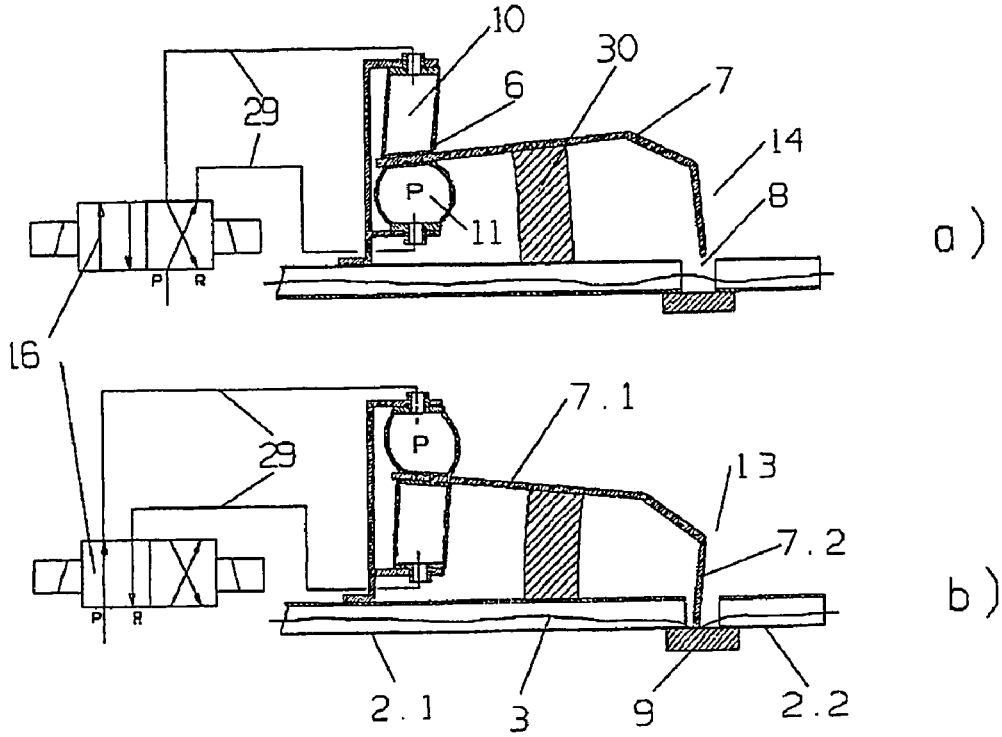
FIG. 14*a*) shows yet a further exemplary embodiment of the invention with an actuator having two chambers, the chambers being arranged perpendicularly to the longitudinal axis of the mixing tube, and with a flexural element additionally provided between the lever and the mixing tube, in the non-clamping position.
FIG. 14*b*) shows the exemplary embodiment according to FIG. 14*a*) in the clamping position.

According to a further exemplary embodiment of the invention, in FIG. 14 an elastomeric actuator 6 with two chambers 10, 11 is arranged at right angles to the longitudinal extent of the main nozzle. The elastomeric actuator in this case likewise has two chambers 10, 11 which are arranged one behind the other in the longitudinal direction and which are separated by an intermediate wall (not designated). The end of the long leg of the lever 7 is held in the intermediate wall. The actuator 6 provided with two chambers 10, 11 is fastened to the mixing tube by means of a doubly angled carrier. The two chambers 10, 11 can again be acted upon separately by actuation means via a 4/2-way valve 16 and corresponding supply lines 29. In addition to the two-chamber actuator, an elastic flexural element 30 is arranged between the actuator and the short leg 7.2 of the lever 7. This elastic flexural element 30, on the one hand, brings about additional support and, on the other hand, also acts as a spring element. The tilt axis of the lever 7 runs through the upper region of the flexural element 30.

In the position of the controllable valve 16 according to FIG. 14*a*), the lower chamber 11 is acted upon with an increased pressure of the actuation means, with the result that this chamber assumes a barrel-shaped form and is shortened in its longitudinal extent. The lever 7 is thus pulled downward with its end about its tilt axis on the flexural element in the intermediate wall between the chambers 10 and 11, so that the short leg 7.2 emerges completely out of the orifice 8 between the portions 2.1 and 2.2 of the mixing tube. This represents the non-clamping position 14 with a completely emerged short leg of the lever 7. In the position of the controllable valve 16 according to FIG. 14*b*), the upper chamber 10 of the actuator 6 is acted upon with an increased pressure of the actuation means, with the result that said chamber assumes a barrel-shaped form. Its longitudinal extent is thereby shortened, with the result that that end of the long leg which is located in the intermediate wall between the chambers 10, 11 is pulled upward about the center of rotation or the tilt axis located on the flexural element. The short leg of the lever 7 is thereby tilted into the orifice 8 of the mixing tube, so that the underside of the short leg 7.2 clamps the weft thread reliably on the abutment 9.

Figure 15:
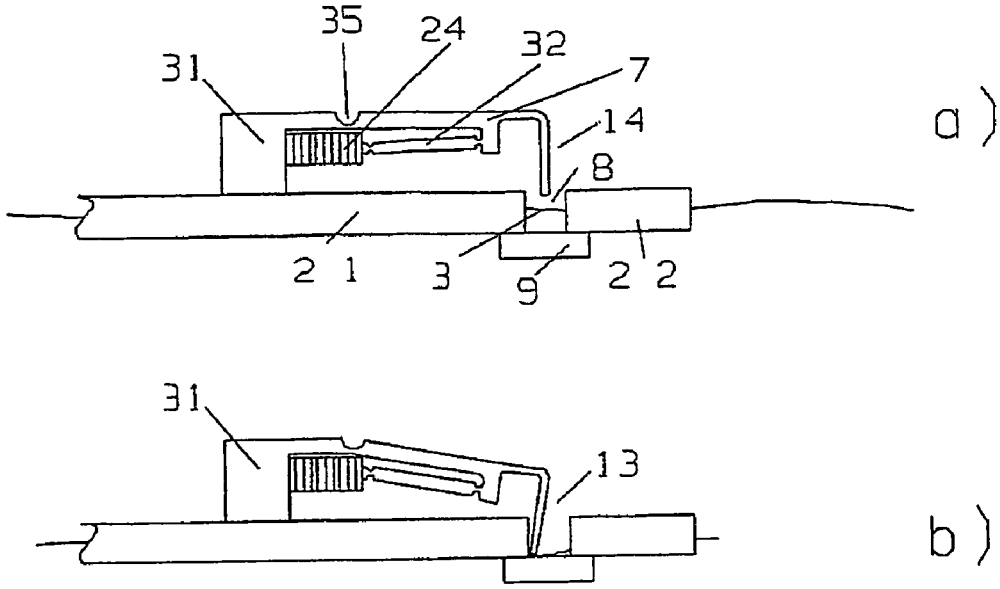
FIG. 15*a*) shows yet a further exemplary embodiment according to the invention with a piezoelectric element as an actuator in the non-clamping position.
FIG. 15*b*) shows the exemplary embodiment according to FIG. 15*a*) in the clamping position.
Figure 16:
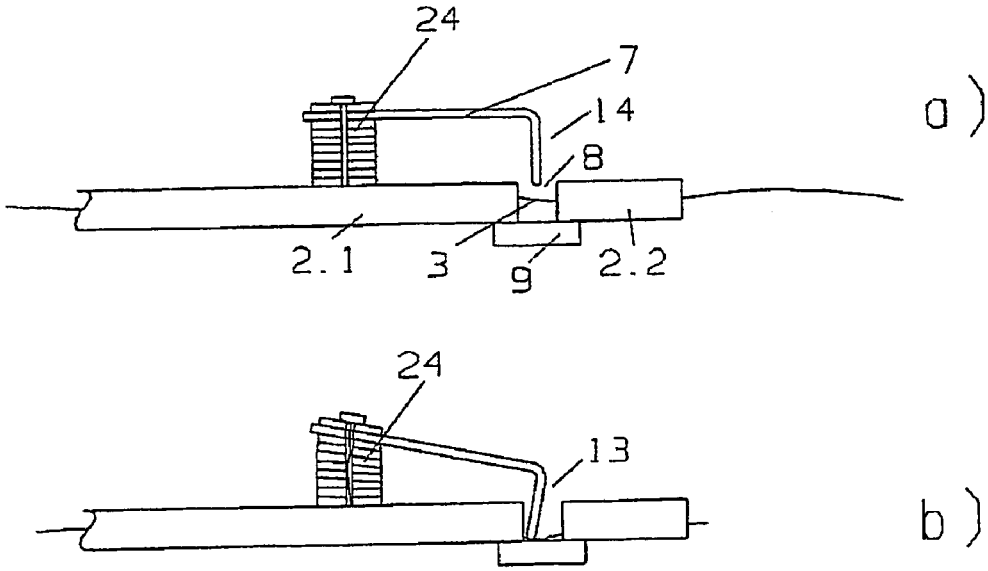
FIG. 16*a*) shows yet a further exemplary embodiment according to the invention with a piezoelectric element as a stack block, in the non-clamping position.
FIG. 16*b*) shows the exemplary embodiment according to FIG. 16*a*) in the clamping position.
Figure 17:
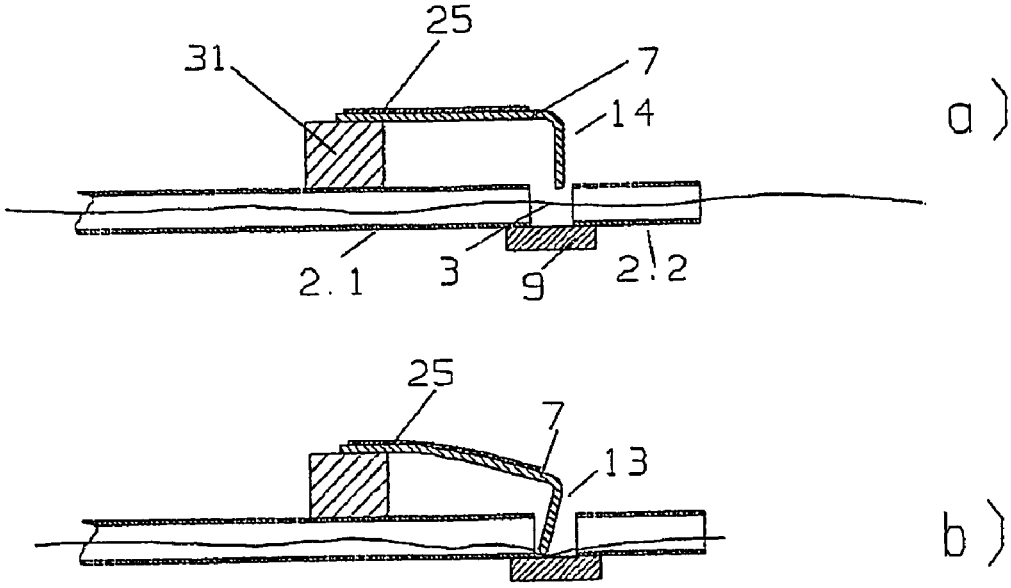
FIG. 17*a*) shows a further exemplary embodiment according to the invention with a piezoelectric element in the form of a flexural converter on the lever, in the non-clamping position.
FIG. 17*b*) shows the exemplary embodiment according to FIG. 17*a*) in the clamping position.

FIGS. 15, 16 and 17 illustrate further exemplary embodiments according to the invention, in which piezoelectric elements are provided instead of the chambers which, in an elastomeric actuator, cause a deformation of the latter. These piezoelectric elements execute a contraction when activated by means of a current. In the exemplary embodiments according to FIGS. 15, 16 and 17, this contraction is transmitted in various ways to the lever 7 causing the actual clamping. According to FIG. 15*a*), a holder 31 is provided, to which the lever 7 is integrally connected. Similarly, the lever 7 has a long leg and a short leg. The short leg is angled essentially at right angles to the long leg. Between the holder 31 and the end of the long leg of the lever 7, a cross-sectional attenuation 35 is provided, which gives rise to an easier tilting movement of the lever 7 when the piezoelectric element 24 is acted upon by a current. For this purpose, a stack of piezoelectric elements 24 is connected to the underside of the long leg of the lever 7 via a connection member 32. In a similar way to the other exemplary embodiments, the mixing tube is subdivided into a first portion 2.1 and a second portion 2.2 and in the clamping region has an orifice 8 and an abutment 9 lying opposite the orifice 8. FIG. 15*a*) illustrates the non-clamping position 14 in which the piezoelectric elements 24 are not acted upon by current.

When the piezoelectric elements 24 are acted upon by current according to FIG. 15*b*), the piezoelectric elements combined into a stack execute a contraction which has the effect that the connection member 32 moves the lever 7 about the tilt axis at the attenuated cross section into the orifice 8 between the two portions 2.1 and 2.2 of the mixing tube and against the abutment 9. The weft thread 3 is thereby reliably clamped against the abutment 9.

It is also possible, however, to provide a stack of piezoelectric elements 24 in the form of what is known as a stack block. This stack block is connected, on the one hand, directly to that end of the long leg of the lever 7 which is arranged opposite the angled short leg carrying out the clamping and, on the other hand, to the mixing tube. Similarly, the mixing tube is subdivided into a first portion 2.1 and a second portion 2.2 which are connected to one another on the underside by means of an abutment 9. FIG. 16*a*) shows the non-clamping position 14, in which the stack block is not acted upon by current. When current is applied to the piezoelectric elements 24, in the case of an appropriate formation of the stack block the latter can execute a contraction movement on one side, with the result that the lever 7 executes a tilting movement. The result of the tilting movement is that the short leg of the lever 7 penetrates into the orifice 8 between the first portion 2.1 and the second portion 2.2 of the mixing tube and reliably clamps the weft thread 3 against the abutment 9.

According to the exemplary embodiment illustrated in FIG. 17, the piezoelectric element may also be provided in the form of a flexural converter 25 which is arranged so as to extend on that side of the long leg of the lever 7 which faces away from the mixing tube, essentially over the entire length of the leg. The lever 7 is fastened with that end of the long leg which lies opposite the angled end of the short leg to a holder 31 which is itself fastened correspondingly to the mixing tube. If, then, as shown in FIG. 17*b*) current is applied to the flexural converter 25, the latter is curved. This curvature is transmitted to the lever 7, so that the latter executes a tilting movement about the fastening of the lever to the holder 31, with the result that the short leg of the lever 7 penetrates into the orifice of the mixing tube and clamps the weft thread on the abutment 9. This position represents the clamping position 13. The essential advantage of the piezoelectric elements 24, 25 instead of an elastomeric actuator is that no additional supply lines with actuation means, for example, in the form of compressed air or hydraulics have to be provided, but, on the contrary, electrical lines which are simple to lay can be arranged. The need for valves to act upon chambers in an elastomeric actuator is likewise avoided in these exemplary embodiments.

Figure 18:
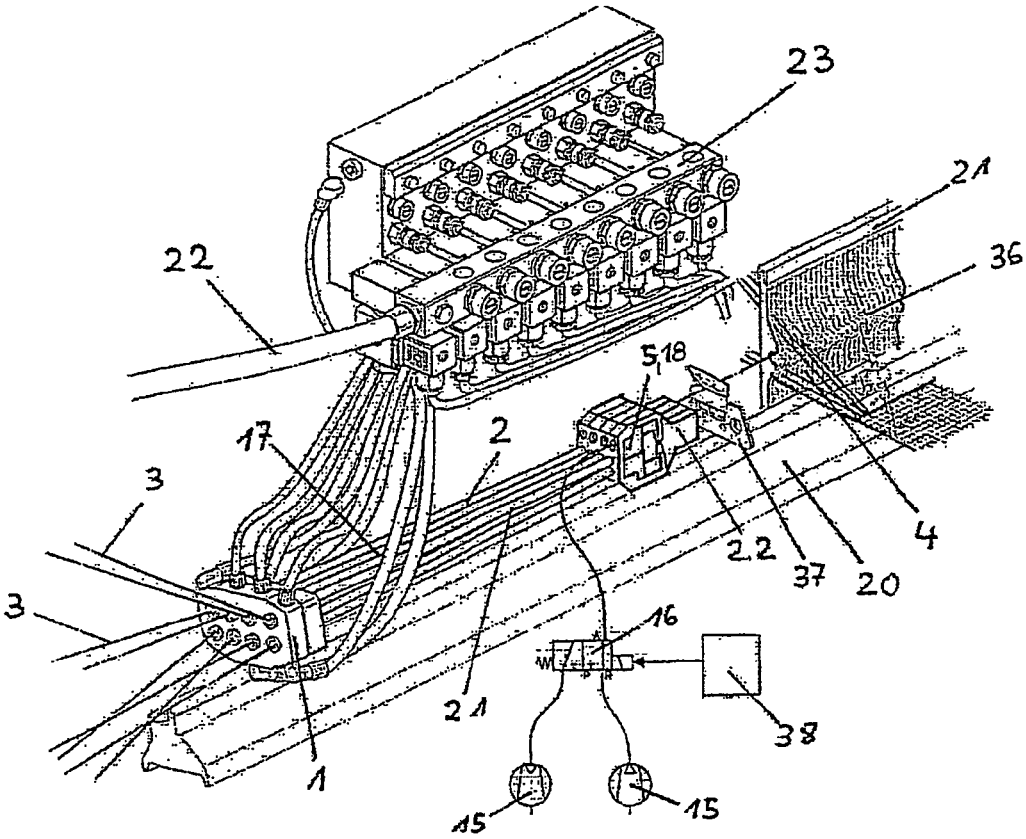
FIG. 18 shows, in a basic illustration, an overall view of a block of main blow nozzles with mixing tubes and a clamping device on a batten.

FIG. 18 illustrates basically an arrangement of a block of main nozzles 1 with corresponding mixing tubes 2 for a jet-weaving machine for weaving eight colors or eight different materials of weft threads. The weft threads 3 are supplied in each case to the main nozzles. The main nozzles 1 are provided with blowing air via a distributor 23. The distributor 23 is supplied with compressed air via a central air supply 22. At the end of the mixing tubes 2 of the main nozzle block 17 is provided a clamping device 5 which subdivides the mixing tubes into a first portion 2.1 and a second portion 2.2. The weft thread is inserted from the outlet of the corresponding mixing tube 2 into a weft insertion channel 36 in the reed 21. Between the outlet orifice of the mixing tube 2 and the weft insertion channel 36 are located shears 37 which cut off the weft thread 3 after insertion into the weft insertion channel 36 in the shed 4 has taken place. Owing to the movement of the batten 20 together with the reed 21, the weft thread 3 is then beaten up to the tying point of the finished fabric (not designated). The clamping device 5 is activated by means of an additional air supply device via corresponding pumps 15 and valves 16 such that the weft thread 3, before it is cut off by means of the shears 37, can be clamped in the mixing tube 2, so that it is prevented from jumping back into the mixing tube. The valves 16 are activated via a corresponding control device, not illustrated. This activation takes place depending on which weft thread has to be inserted or cut off.

Figure 19:
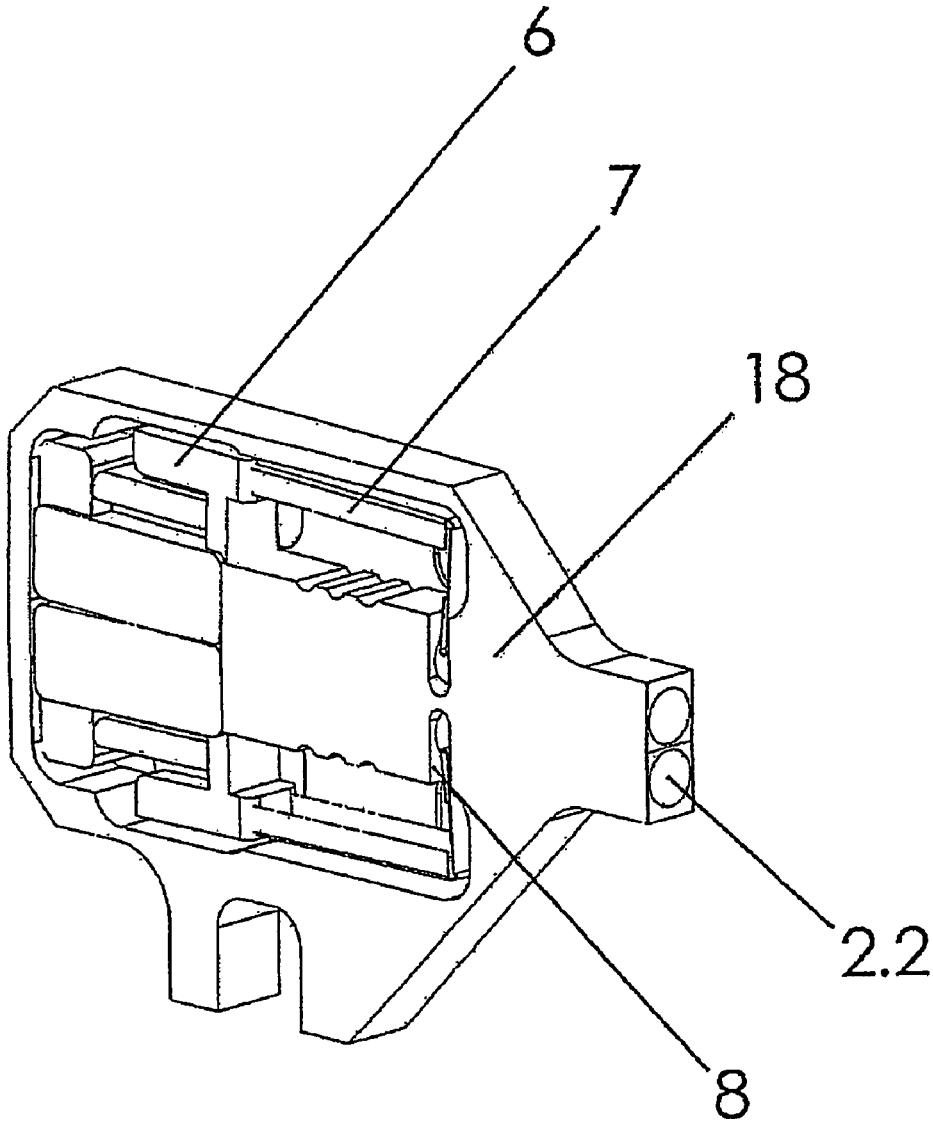
FIG. 19 shows a modular unit, in which two clamping devices are combined in the form of a frame in a mutually opposite arrangement.

So that a compact arrangement of the clamping device 5 at the end of the block 17 of main nozzles 1 with mixing tube 2 can be ensured, that is to say as close an arrangement of the ends of the mixing tubes to one another as possible can be ensured, the corresponding clamping devices are arranged in each case on opposite sides of the mixing tubes. The mixing tubes are always arranged one above the other in pairs, so that a clamping device is arranged on the top side and the clamping device of the mixing tube lying beneath it is arranged on its underside. By means of a modular unit 18, which by a frame-shaped design combines the two clamping devices arranged opposite one another at 180°, high compactness is achieved. In an 8-tube arrangement of the mixing tubes, four frame-shaped modular units 18 of this type are arranged next to one another. Such a modular unit 18 is illustrated in FIG. 19. An elastomeric actuator 6 and a lever 7 fastened to it or together with it can be seen in each case. When the elastomeric actuator 6 is acted upon correspondingly, the lever 7 experiences a tilting movement and penetrates with its short leg into the orifice 8 between the first portion 2.1 (not illustrated) and the second portion 2.2 of the mixing tube. Furthermore, the frame-shaped combination of two clamping devices in each case also gives rise, in addition to compactness, to a rigid design which withstands the back-and-forth movement of the batten 20 including the accelerations occurring in this case.

Figure 20:
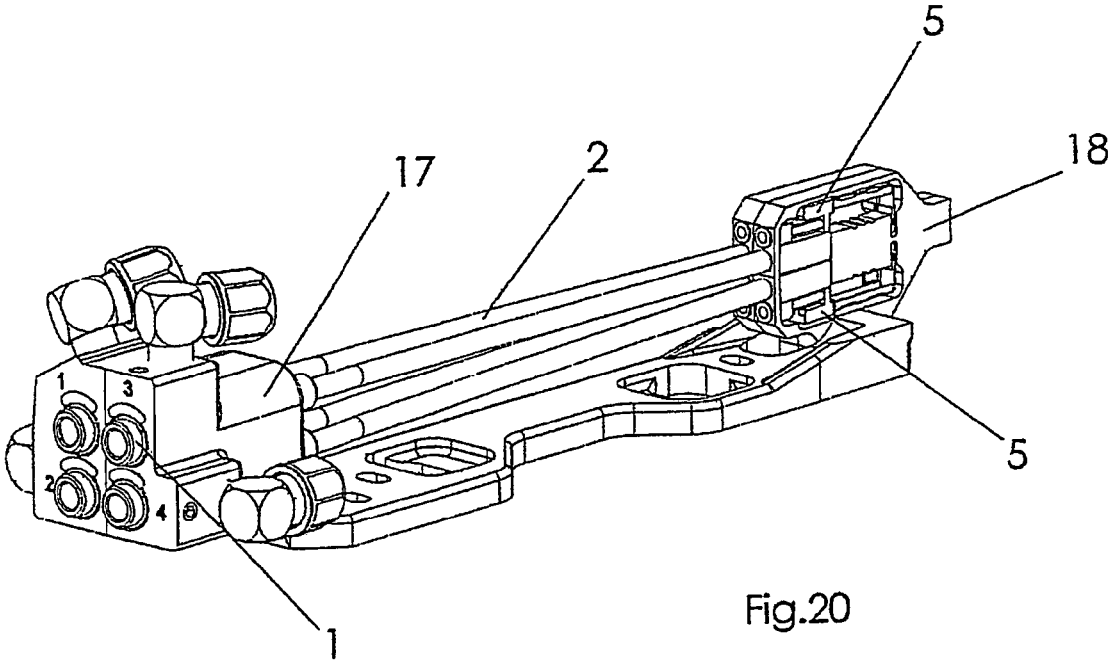
FIG. 20 shows a unit consisting of four main blow nozzles with corresponding mixing tubes and two modular units combining in each case two clamping devices of two adjacent mixing tubes.

To illustrate how the modular units 18 combine the clamping devices in pairs at the ends of the mixing tube 2 which point toward the shed, FIG. 20 illustrates in a basic view a main nozzle arrangement with four main nozzles 1 and four respective mixing tubes 2 and two modular units 18 of this type. FIG. 20 illustrates that, despite the fact that each mixing tube 2 is provided separately with a clamping device 5 which in each case has to be activatable separately, the individual mixing tubes 2 are arranged highly compactly and closely to one another and, due to the frame-shaped structure of the modular unit 18, additionally have a stiffening particularly of the end region of the mixing tubes 2 of the block 17 of main nozzle 1 and mixing tube 2.

It will be appreciated that, in addition to the numerous exemplary embodiments of the invention which have been described, further possibilities for clamping devices 5 for a jet-weaving machine according to the invention are possible. Thus, it is possible to provide elastomeric or piezo-controlled actuators which transmit their respective movement to a displaceable wedge element which, in turn, causes a tilting movement of the clamping lever. It is also possible to bring about the tilting movement of the lever of the clamping device by means of electromagnetic actuating members.

The invention claimed is:

1. A jet weaving machine comprising:

a main blow nozzle adapted to blow a transport fluid and therewith insert a weft thread into a loom shed of said jet weaving machine, wherein said main blow nozzle comprises a mixing tube having an inlet end facing away from said loom shed, an outlet end facing toward said loom shed, a mixing tube passage extending from said inlet end to said outlet end, and a clamp opening that opens into said mixing tube passage closer to said outlet end than to said inlet end;

a thread clamping abutment arranged bounding said mixing tube passage; and a thread clamping device comprising an actuator and a lever;

wherein:

said actuator is arranged outside of said mixing tube and comprises at least one elastomeric deformable chamber, which has an actuating medium port communicating into a void space defined within said chamber, and which is elastically deformable so as to undergo an elastic deformation when an actuating medium is supplied into and/or removed from said void space through said port, said lever is fastened to said actuator arid arranged so that, due to said elastic deformation of said elastomeric deformable chamber, said lever and said actuator together undergo a tilting or pivoting movement between a clamping position and a non-clamping position, in said clamping position, said lever extends through said clamp opening and is positioned to clamp the thread between said lever and said thread clamping abutment, and in said non-clamping position, said lever is positioned so as to leave a space and not clamp the thread between said lever and said thread clamping abutment.

2. The jet weaving machine according to claim 1, wherein said elastomeric deformable chamber comprises an elastomeric bellows.

3. The jet weaving machine according to claim 1, wherein said lever is fastened directly to said elastomeric deformable chamber.

4. The jet weaving machine according to claim 3, wherein said lever is fastened directly to said elastomeric deformable chamber by being adhesively bonded or glued thereto.

5. The jet weaving machine according to claim 3, wherein said lever is fastened directly to said elastomeric deformable chamber by being vulcanized thereon or therein.

6. The jet weaving machine according to claim 3, wherein said lever is fastened directly to said elastomeric deformable chamber by being plugged onto or into said elastomeric deformable chamber.

7. The jet weaving machine according to claim 1, wherein said actuator is mounted externally on said mixing tube.

8. The jet weaving machine according to claim 1, wherein said actuator has a through-hole with a circular cross-section, and said mixing tube is plugged firmly into said through-hole so as to mount said actuator externally on said mixing tube.

9. The jet weaving machine according to claim 1, further comprising a pivotable loom batten carrying a reed, wherein said main blow nozzle and said thread clamping device are mounted on said batten.

10. The jet weaving machine according to claim 1, wherein said lever comprises a one-piece lever element bent to have a longer lever leg that is fastened to said actuator, a shorter lever leg that is bent at an angle from a free end of said longer lever leg and that extends through said clamp opening at least in said clamping position, and a folded-over end piece that is folded over at a free end of said shorter lever leg to form a folded curved clamping surface that faces said thread clamping abutment so as to clamp the thread between said folded curved clamping surface of said lever and said thread clamping abutment when said lever is in said clamping position.

11. The jet weaving machine according to claim 1, wherein said lever still extends through said clamp opening and a portion of said lever is in said mixing tube passage when said lever is in said non-clamping position.

12. The jet weaving machine according to claim 1, wherein said lever does not extend through said clamp opening and said lever is entirely outside of said mixing tube passage when said lever is in said non-clamping position.

13. The jet weaving machine according to claim 1, wherein said thread clamping abutment is positioned opposite said lever with said mixing tube passage therebetween, and said lever is arranged to move through said mixing tube passage toward said thread clamping abutment when changing from said non-clamping position to said clamping position by said tilting or pivoting movement.

14. The jet weaving machine according to claim 1, wherein said thread clamping abutment is positioned on a same side of said mixing tube passage from which said lever extends through said clamp opening into said mixing tube passage, said, lever has a stirrup or eye at a free end thereof in said mixing tube passage, said stirrup or eye is arranged and adapted to have the thread extending therethrough, and said lever by said tilting or pivoting movement moves in a direction outwardly out of said clamp opening so that said stirrup or eye pulls the thread against said thread clamping abutment when changing from said non-clamping position to said clamping position.

15. The jet weaving machine according to claim 1, wherein said clamp opening divides said mixing tube into a first tube portion extending from said inlet end to said clamp opening and a second tube portion extending from said clamp opening to said outlet end, said thread clamping device is mounted on said first tube portion, said second tube portion is markedly shorter than said first tube portion, said first and second tube portions are axially aligned with one another along a common central tube axis, said thread clamping abutment has a thread clamping surface with an increased coefficient of friction relative to said mixing tube, and said thread clamping abutment interconnects said first and second tube portions to one another across said clamp opening.

16. The jet weaving machine according to claim 1, wherein said thread clamping device further comprises a spring element that is interposed and connected between said lever and said mixing tube and that is elastically flexible to exert a spring bias force on said lever when said lever undergoes said tilting or pivoting movement.

17. The jet weaving machine according to claim 16, wherein said spring element is so arranged and adapted to exert said spring bias force on said lever in a direction from said clamping position to said non-clamping position.

18. The jet weaving machine according to claim 1, wherein said at least one elastomeric deformable chamber of said actuator includes two said elastomeric deformable chambers that respectively define two said void spaces therein, and wherein said actuating medium can be supplied into and/or removed from said two void spaces alternately to respectively cause two different elastic deformations of said chambers and drive said tilting or pivoting movement respectively alternately to said clamping position and to said non-clamping position.

19. The jet weaving machine according to claim 1, further comprising an air supply that is connected to said main blow nozzle and that is adapted to supply compressed air as said transport fluid, and wherein said air supply is also connected to said actuating medium port to supply said compressed air as said actuating medium.

20. The jet weaving machine according to claim 1, wherein said at least one elastomeric deformable chamber is deformable responsive to said actuating medium being supplied selectively at an overpressure and selectively at an underpressure.

21. The jet weaving machine according to claim 1, further comprising at least one pump adapted to pump said actuating medium, and controllable valves that are interposed and connected between said at least one pump and said actuating medium port and that are adapted to control a supply of said actuating medium to said void space and/or a removal of said actuating medium from said void space.

22. The jet weaving machine according to claim 1, comprising a plurality of said main blow nozzles respectively having a corresponding plurality of said mixing tubes, and a corresponding plurality of said thread clamping devices with a corresponding plurality of said actuators and of said levers, wherein a pair of said thread clamping devices is connected together to form a modular unit, and two said actuators of said modular unit are arranged oriented back-to-back opposite one another respectively on an adjacent pair of said mixing tubes, with two said levers of said modular unit arranged opposite one another on opposite sides of said adjacent pair of said mixing tubes, so that said mixing tubes of said adjacent pair and said two actuators and said two levers of said modular unit are arranged back-to-back symmetrically relative to one another 23. A thread clamping device for a jet weaving machine, comprising:

an actuator that is configured and adapted to be mounted outside on a mixing tube of a main weft insertion nozzle of the jet weaving machine, and that comprises at least one elastomeric deformable chamber defining a void space therein and having an actuating medium port communicating into said void space; and a thread clamping lever that is fastened to said actuator and that has a thread clamping surface at a free end thereof;

wherein:

said chamber is elastically deformable so as to undergo an elastic deformation when an actuating medium is supplied into and/or removed from said void space through said port, and said thread clamping lever is arranged and fastened to said actuator such that, due to said elastic deformation of said chamber, said lever and said actuator are adapted to together undergo a tilting or pivoting movement between a clamping position in which said thread clamping surface of said thread clamping lever is adapted to clamp a weft thread in the mixing tube, and a non-clamping position in which said thread clamping lever is adapted to release the weft thread.

24. The thread clamping device according claim 23, wherein said lever is fastened directly to said elastomeric deformable chamber.

25. The thread clamping device according to claim 23, wherein said actuator has a through-hole with a circular cross-section adapted to be plugged firmly onto the mixing tube so as to mount said actuator outside on the mixing tube.

26. A thread clamping arrangement for a jet weaving machine, comprising two thread clamping devices that are arranged back-to-back symmetrically relative to one another and that are connected together to form a modular unit, wherein each one of said thread clamping devices respectively comprises:

an actuator that is configured and adapted to be mounted outside on a respective mixing tube of a respective main weft insertion nozzle of the jet weaving machine, and that comprises at least one elastomeric deformable chamber defining a void space therein and having an actuating medium port communicating into said void space; and a thread clamping lever that is fastened to said actuator and that has a thread clamping surface at a free end thereof;

wherein:

said chamber is elastically deformable so as to undergo an elastic deformation when an actuating medium is supplied into and/or removed from said void space through said port, and said thread clamping lever is arranged and fastened to said actuator such that, due to said elastic deformation of said chamber, said lever and said actuator are adapted to together undergo a tilting or pivoting movement between a clamping position in which said thread clamping surface of said thread clamping lever is adapted to clamp a weft thread in the mixing tube, and a non-clamping position in which said thread clamping lever is adapted to release the weft thread.

* * * * *

UNITED STATES PATENT AND TRADEMARK OFFICE

CERTIFICATE OF CORRECTION

PATENT NO. : 7,537,029 B2
APPLICATION NO. : 11/658984
DATED : May 26, 2009
INVENTOR(S) : Gielen et al.

It is certified that error appears in the above-identified patent and that said Letters Patent is hereby corrected as shown below:

On the cover page,

[*] Notice: Subject to any disclaimer, the term of this patent is extended or adjusted under 35 USC 154(b) by 153 days Delete the phrase "by 153 days" and insert -- by 139 days --

Signed and Sealed this

Twelfth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,537,029 B2
APPLICATION NO. : 11/658984
DATED : May 26, 2009
INVENTOR(S) : Gielen et al.

It is certified that error appears in the above-identified patent and that said Letters Patent is hereby corrected as shown below:

Column 12,
Line 54, after “approximately”, replace “45’” by --45°--;

Column 16,
Line 43, after “actuator”, replace “arid” by --and--;

Column 17,
Line 45, replace “said, lever” by --said lever--;

Column 18,
Line 52, after “one”, replace “another” by --another.--;

Column 19,
Line 10, after “according”, insert --to--.

Signed and Sealed this
Twenty-fifth Day of January, 2011

David J. Kappos

David J. Kappos
*Director of the United States Patent and Trademark Office*